US012570378B2

(12) United States Patent
Campi

(10) Patent No.: US 12,570,378 B2
(45) Date of Patent: Mar. 10, 2026

(54) ACCESSORY FOR WATER BOARD FOR SPORT OR RECREATION

(71) Applicant: The Leisure Collective International Pty Ltd, Dunsborough (AU)

(72) Inventor: Beau Wayan Campi, Dunsborough (AU)

(73) Assignee: The Leisure Collective International Pty Ltd, Dunsborough (AU)

( * ) Notice: Subject to any disclaimer, the term of this patent is extended or adjusted under 35 U.S.C. 154(b) by 511 days.

(21) Appl. No.: 17/937,368

(22) Filed: Sep. 30, 2022

(65) Prior Publication Data

US 2023/0029809 A1 Feb. 2, 2023

Related U.S. Application Data

(63) Continuation of application No. PCT/AU2021/050311, filed on Apr. 2, 2021.

(30) Foreign Application Priority Data

Apr. 2, 2020 (AU) ..... 2020901028
Dec. 4, 2020 (AU) ..... 2020904504

(51) Int. Cl.
*B63B 32/40* (2020.01)
*B63B 32/70* (2020.01)

(52) U.S. Cl.
CPC ..... *B63B 32/40* (2020.02); *B63B 32/45* (2020.02); *B63B 32/70* (2020.02)

(58) Field of Classification Search
CPC ..... B63B 32/00; B63B 32/40; B63B 1/00; B63B 32/45; B63B 32/70
(Continued)

(56) References Cited

U.S. PATENT DOCUMENTS 5,435,765 A 7/1995 Fletcher
5,766,051 A * 6/1998 Messer ..... B63B 32/40 441/74
(Continued)

FOREIGN PATENT DOCUMENTS

AU 2006241357 12/2006
WO WO 2003/055743 7/2003
(Continued)

OTHER PUBLICATIONS

Creatures of Leisure: Mick Fanning signature traction pad, <URL:https://www.creatures.com.au/products/mick-fanning-signature>.
(Continued)

*Primary Examiner* — Lars A Olson
(74) *Attorney, Agent, or Firm* — Howson & Howson LLP

(57) ABSTRACT

A traction pad for fixing to a water board has a contoured upper surface with raised portions protruding therefrom by a protrusion height relative to the contoured surface, some of the raised portions include a higher portion of greater protrusion height than a lower portion; a proportion of the raised portions in one or more regions of the contoured surface have the respective higher portion located in a particular direction on the respective raised portion. A kick for a water board can include a curved or concave lower surface. The kick can have holes in a back face and/or a slot into an upper or lower surface.

26 Claims, 17 Drawing Sheets

(58) Field of Classification Search
USPC ..... 441/65, 74
See application file for complete search history.

(56) References Cited

U.S. PATENT DOCUMENTS

| | | | | |
|---|---|---|---|---|
| 6,767,264 | B2 * | 7/2004 | Mercer | B63B 32/70 441/74 |
| 7,316,597 | B2 * | 1/2008 | Skedeleski | B63B 32/70 441/74 |
| 2003/0124923 | A1 | 7/2003 | Mercer | |
| 2007/0054573 | A1 | 3/2007 | Skedeleski | |
| 2007/0155262 | A1 | 7/2007 | Tung | |
| 2019/0118912 | A1 | 4/2019 | Verdadeiro Marques | |

FOREIGN PATENT DOCUMENTS

| | | | |
|---|---|---|---|
| WO | 2017/158576 | A1 | 9/2017 |
| WO | WO 2021/195720 | | 10/2021 |

OTHER PUBLICATIONS

Second Office Action issued on Jan. 25, 2025 in counterpart Chinese Patent Application No. 202180031898.7.

* cited by examiner

ACCESSORY FOR WATER BOARD FOR SPORT OR RECREATION

CROSS-REFERENCE TO RELATED APPLICATIONS

This application is a continuation of International Patent Application No. PCT/AU2021/050311, filed Apr. 2, 2021, which claims priority to Australian Application Nos. 2020901028, filed Apr. 2, 2020, and 2020904504, filed Dec. 4, 2020, all of which are incorporated by reference herein in their entireties.

TECHNICAL FIELD

The present invention relates to accessories for water boards for use in sports and/or recreation.

One or more particular applications of the present invention relates to traction pads (aka tail pads, kick pads or deck pads) and/or components thereof, such as a kick, for such water boards.

BACKGROUND

Traction pads are used to provide improved grip between a water sports and recreation board and its user, typically a surfboard and a surfer, in place of wax which was more commonly used up until the late 1970's. An adhesive layer is provided on the lower surface or underside of the traction pad for fixing the traction pad onto the upper surface of the surfboard and a textured finish is provided on the top or upper side of the traction pad to assist with grip.

However, the lower surface of the traction pad is not smooth where the grip or traction pad has residual stress, either due to manufacturing or installation, creating a less than ideal situation for the adhesion of the traction pad to the surfboard.

Traction pads can be split into multiple sections, for example, typically three longitudinal portions can be formed by cutting a longitudinal line through the traction pad on either side of the arch. This can help the traction pad to conform to the laterally curved top surface of a surfboard.

Additionally or alternatively, a series of holes or perforations can be cut into or through the traction pad. Holes through the top surface of the traction pad can assist with providing grip between the surfer and the traction pad. Such holes can also lighten the traction pad and change the local effective stiffness as the area that is supporting the load from the surfer is reduced by those holes, effectively increasing the pressure from contact with the surfer when compared to the pressure in the material of a flat un-perforated traction pad to react loads from the surfer. Also, the compressed material surrounding a hole or perforation can expand sideways into the hole which can also reduce the effective stiffness of the traction pad.

The textured finish provided on the top or upper side of the traction pad to assist with grip is typically formed by cutting into the material of the deck. This results in a uniform pattern of raised features.

A traction pad can have a sloped step or 'kick' at a rear of the traction pad (towards the tail end of a surfboard, for example) for a user to increase traction with their rear foot, such as for making turns.

SUMMARY OF INVENTION

According to a first aspect of the invention there is provided a traction pad for a water board comprising at least a kick portion and a deck portion, the deck portion substantially covering a kick upper surface in use; the traction pad having a pad lower surface, wherein the traction pad includes at least one of the following four features: a) the deck portion is moulded to substantially conform to a shape to accommodate the kick portion and/or an arch portion before being fixed, moulded or bonded to said kick portion and/or arch portion; b) the traction pad is formed by moulding the at least a kick portion and/or an arch portion to the deck portion in a mould to control the contour of the pad lower surface, the kick portion and/or the arch portion including a respective contoured upper surface, the deck portion including a lower surface, the traction pad being formed by moulding the respective contoured upper surface of the kick portion and/or the arch portion to a respective kick and/or arch region of the lower surface of the deck portion; c) the kick having, when formed (or prior to installation on a water board), a lower surface contoured to at least partially accommodate the contour of the water board (for example having a large radius curved and/or concave profile to form a gentle arch shape in end view to match or at least approximate the convex shape of a typical water board); and/or d) a connected kick and arch, prior to said connected kick and arch being fixed to the deck portion, wherein the connected kick and arch comprises: an arch portion being connected to at least an outer portion of the kick portion; or the kick portion being connected to at least a base portion of an arch portion; or the kick portion being integrally formed with an arch portion.

When the traction pad includes feature a) where the deck portion is moulded to substantially conform to a shape to accommodate the kick portion and/or an arch portion, the deck is essentially pre-formed to its final shape or substantially closer to its final shape as part of a traction pad. This is in contrast to the flat sheets of material conventionally used to form a deck over non planar surfaces including the upper surfaces of a kick and an arch.

The traction pad may be a one-piece product, or may be created as a one-piece product for, in use, separation into multiple individual traction pad portions together providing a traction pad surface, or may be provided as individual traction pad portions that together provide the traction pad when in use.

The pad lower surface may be a mating, bonding or adhesive surface, being the surface typically adhered to an upper surface of the water board. The pad lower surface may have an adhesive coating.

Each of said four features has a common goal, which is to reduce, assist in minimising, or to provide a low residual stress in the pad lower surface when the traction pad is in use or installed on the water board.

At least the kick portion may have a different density, or different stiffness or different durometer to the deck portion.

The kick portion may comprise at least a first constituent portion and a second constituent portion, the density of the first constituent portion being different to the density of the second constituent portion e.g. different foam densities.

The traction pad may include an arch portion separate from the kick portion, for example when the traction pad excludes the arch portion being connected to or integral with at least the lower portion of the kick portion. The arch portion separate from the kick portion may comprise at least an arch base portion and an arch upper portion.

The pad lower surface may include an adhesive coating.

At a leading edge of the kick, the kick lower surface and pad lower surface may vary in height by less than 1.5 mm (preferably less than 0.8 mm or preferably less than 0.5 mm and more preferably less than 0.3 mm, most preferably less than 0.2 mm or less than 0.1 mm) over a distance of less than 10 mm (preferably less than 5 mm) along the pad lower surface.

The kick portion may have a lower surface contoured to at least partially accommodate the contour of the water board, a lateral centre of the kick portion or of the traction pad under the kick portion being at least 1.5 mm, preferably at least 2 mm higher than lateral edges of the kick or traction pad.

The kick portion may include at least one slot. The slot may preferably be oriented substantially longitudinally and intersecting a kick rear surface and a kick lower or upper surface.

The traction pad may be formed by moulding the at least a kick portion and a deck portion together. A skin may be formed around the traction pad by the action of heat on at least the kick portion and the deck portion.

When the arch portion is connected to at least the outer portion of the kick portion; or the kick portion is connected to at least the base portion of the arch portion; or the kick portion is integrally formed with the arch portion, then a combined kick and arch may be formed. The combined kick and arch may be T-shaped in top view.

When the traction pad includes feature a) the deck portion being moulded to substantially conform to a shape to accommodate a kick portion and/or arch portion, and/or when the traction pad includes feature b) the traction pad is formed by moulding the at least a kick portion and/or an arch portion with or to the deck portion, wherein: the deck portion may include opposing first and second surfaces.

A portion of the first surface may be fixed to or part of the kick and/or an arch, the second surface being a contoured surface, the deck portion may include, or may be moulded to include, raised portions protruding from the contoured surface by a protrusion height relative to the contoured surface, at least some of the raised portions each including a higher portion and a lower portion, the protrusion height of the higher portion being greater than the protrusion height of the lower portion around the respective raised portion.

A proportion of the raised portions in a first region of the contoured surface may have the respective higher portion located towards at least a left direction, in use, on the respective raised portion; a proportion of the raised portions in a second region of the contoured surface may have the respective higher portion located towards at least a forwards direction, in use, on the respective raised portion; and a proportion of the raised portions in a third region of the contoured surface have the respective higher portion located towards at least a right direction, in use, on the respective raised portion.

Throughout this specification, the raised portions can be stepped but need not be stepped. The raised portion can have a stepped profile or a curved or flat profile, optionally changing or tapering in height in the direction preferred in that region although it could change height in a different direction. The raised portions can be inclined between a lower portion and a higher portion. The raised portions can be stepped or inclined, orhave a combination of step and incline, between the lower portions and the higher portions. Inclination can include tapering or sloping between a higher portion having a greater protrusion height than the lower portion relative to the contoured surface.

The kick portion may include at least one rear surface, holes extending into the rear surface.

Another aspect of the present invention provides a traction pad for a water board comprising at least a kick portion and a deck portion, the kick having at least a kick upper surface (being an at least upwards facing surface in use) and a kick lower surface (being a downwards facing surface in use), the deck portion substantially covering the kick upper surface (in use); the traction pad having a pad lower (or mating or adhesive) surface.

The traction pad may be formed by moulding the at least a kick portion and a deck portion together in a mould to control the contour of the pad lower surface.

The kick portion and/or the arch portion may include a respective contoured upper surface, the deck portion including a lower surface, the traction pad being formed by moulding the respective contoured upper surface of the kick portion and/or the arch portion to a respective kick and/or arch region of the lower surface of the deck portion.

The traction pad may be formed by moulding or bonding the at least a kick portion and the deck portion together, such as co-moulding. Forming the traction pad by moulding the at least a kick portion and the deck portion together helps to control the contour of the pad lower surface. Moulding may be by thermal moulding, pressure moulding, or preferably a combination of thermal and pressure moulding. The kick portion and/or the deck portion may be of a thermoset or chemical reaction polymer material. The polymer material may be of or include one or more urethanes.

At least the kick portion may have a different density, or different stiffness or different durometer to the deck portion. Durometer may be a measure of hardness of a material, typically of polymers, elastomers and rubbers.

The kick portion may comprise at least a first constituent portion and a second constituent portion, the density of the first constituent portion being different to the density of the second constituent portion.

The kick portion may have a lower surface contoured to at least partially accommodate the contour of the water board, a lateral centre of the kick portion or of the traction pad under the kick portion being at least 1.5 mm, preferably at least 2 mm higher than lateral edges of the kick or traction pad.

At a leading edge of the kick, the kick lower surface and pad lower surface may vary in height by less than 1.5 mm (preferably less than 0.8 mm or preferably less than 0.5 mm and more preferably less than 0.3 mm, most preferably less than 0.2 mm or less than 0.1 mm) over a distance of less than 10 mm (preferably less than 5 mm) along the pad lower surface.

Another aspect of the present invention provides a traction pad for a water board comprising at least a kick portion and a deck portion, the kick having at least a kick upper surface being an at least upwards facing surface in use and a kick lower surface being a downwards facing surface in use, the deck portion substantially covering the kick upper surface, in use; the traction pad having a pad lower (or mating or adhesive) surface, wherein the kick lower surface is contoured (when formed or prior to installation on a water board) to at least partially accommodate the contour of the water board. For example, the kick may have a large radius concave profile to form a gentle arch shape in end view to match or at least approximate the convex shape of a typical water board.

The contour of the kick may minimise or prevent the need for the kick to bend to conform to the shape of the water board when fitted, thereby minimising residual stress in the kick due to board curvature and reducing the tensile loads in the adhesive under the edges of the kick.

A lateral centre of the kick portion or of the traction pad under the kick portion may be at least 1.5 mm, preferably at least 2 mm higher than lateral edges of the kick or traction pad.

The kick portion may include at least one slot. The slot may preferably be oriented substantially longitudinally and intersecting a kick rear surface and a kick lower or upper surface.

The traction pad may be formed by moulding the at least a kick portion and the a deck portion together.

At a leading edge of the kick, the kick lower surface and pad lower surface may vary in height by less than 1.5 mm over a distance of less than 10 mm along the pad lower surface. Preferably the pad lower surface may vary in height by less than 0.8 mm or preferably less than 0.5 mm and more preferably less than 0.3 mm, most preferably less than 0.2 mm or less than 0.1 mm. The specified variation in height may preferably be over a distance of less than 5 mm from the leading edge (or forward edge) of the kick along the pad lower surface.

Another aspect of the present invention provides a traction pad for a water board comprising at least a kick portion and a deck portion, the kick having at least a kick upper surface being an at least upwards facing surface in use and a kick lower surface being a downwards facing surface in use, the deck portion substantially covering the kick upper surface in use; the traction pad having a pad lower (or mating or adhesive) surface, wherein the traction pad includes a connected kick and arch, prior to said connected kick and arch being fixed to the deck portion, wherein the connected kick and arch comprises: an arch portion being connected to at least an outer portion of the kick portion; or the kick portion being connected to at least a base portion of an arch portion; or the kick portion being integrally formed with an arch portion.

A combined kick and arch may be formed. The combined kick and arch may be T-shaped in top view. The kick portion may include at least one slot. The slot may preferably be oriented substantially longitudinally and intersecting a kick rear surface and a kick lower or upper surface.

Another aspect of the present invention provides a traction pad for a water board comprising at least a kick portion, an arch portion and a deck portion, wherein at least one of the kick portion, the arch portion and the deck portion includes or comprises multiple layers of different stiffness material. For example, at least one of the kick portion, arch portion and/or deck portion may comprise multiple layers of different materials bonded or moulded together. Alternatively or additionally, at least one of the kick portion, arch portion and/or deck portion may comprise or include an aerated core within a denser, stronger skin.

The multiple layers of different stiffness material may comprise at least two layers of different stiffness. For example, if three or more layers are provided, two of the layers may have the same stiffness, i.e., a first layer may have a first stiffness, a second layer may have a second stiffness and a third layer may have the first stiffness or alternatively may have a third stiffness.

The multiple layers of the at least one of the kick portion, the arch portion and the deck portion may be bonded together, for example, to form the respective kick portion, arch portion or deck portion.

Alternatively, or additionally, the multiple layers of the at least one of the kick portion, the arch portion and the deck portion may be moulded together. For example, the multiple layers may be cut, moulded or otherwise formed, then fixed together by being moulded together to form the respective kick portion, arch portion or deck portion). Alternatively, the multiple layers may be formed in a single mould, such as forming an aerated core with a denser skin around the periphery of the respective kick, arch or deck portion.

Another aspect of the present invention provides a traction pad for a water board comprising at least a kick portion and a deck portion, the kick having at least a kick upper surface and a kick lower surface, the deck portion substantially covering the kick upper surface (in use); the traction pad having a pad lower (or mating or adhesive) surface, wherein the deck portion is a shaped deck portion moulded to substantially conform to a shape to accommodate the kick portion and/or an arch portion before being fixed, moulded or bonded to said kick portion and/or said arch portion.

The deck portion may have an upwards facing contoured surface and raised portions protruding from the raised surface by a protrusion height relative to the contoured surface, at least some of the raised portions may include a higher portion and a lower portion, the protrusion height of the higher portion being greater than the protrusion height of the lower portion around the respective raised portion; a proportion of the raised portions in a first region of the contoured surface may have the respective higher portion located towards at least a left direction, in use. on the respective raised portion; a proportion of the raised portions in a second region of the contoured surface may have the respective higher portion located towards at least a forwards direction, in use, on the respective raised portion; a proportion of the raised portions in a third region of the contoured surface may have the respective higher portion located towards at least a right direction, in use, on the respective raised portion.

The deck portion may have a lower surface, the lower surface including: a kick region sloping upwardly towards a back edge of the deck to accommodate the kick portion of the traction pad; and/or an arch region towards a centre of the deck and being curved upwardly to accommodate the arch portion. The kick region of the deck may be separated (or differentiated) from (the majority of, or at least a portion of) the remainder of the lower surface of the deck by an angled feature shaped to match a leading edge of the kick. So, the kick region of the deck may be angled relative to at least a portion of the remainder of the lower surface of the deck. Similarly, the arch region may be separated from the remainder of the lower surface of the deck by an angled feature shaped to match a profile of the arch portion.

Alternatively, the deck portion may have a lower surface, the lower surface including a substantially planar region and further including: a kick region sloping upwardly towards a back edge of the deck to accommodate the kick portion of the traction pad; and/or an arch region towards a centre of the deck and being raised above the substantially planar region to accommodate the arch portion.

The traction pad may be formed by moulding the shaped deck portion to the kick portion and/or an arch portion.

Another aspect of the present invention provides a moulded deck for a traction pad for a water board, the moulded deck having an upper surface including raised portions.

The raised portions may protrude from the upper surface by a protrusion height relative to the upper surface, at least some of the raised portions including a higher portion and a lower portion, the protrusion height of the higher portion being greater than the protrusion height of the lower portion around the respective raised portion; a proportion of the raised portions in a first region of the upper surface have the respective higher portion located towards at least a left direction, in use, on the respective raised portion; a proportion of the raised portions in a second region of the upper surface have the respective higher portion located towards at least a forwards direction, in use, on the respective raised portion; and a proportion of the raised portions in a third region of the upper surface have the respective higher portion located towards at least a right direction, in use, on the respective raised portion.

The deck may be moulded to substantially accommodate a kick portion and/or arch portion. For example, the deck may be moulded into a contour to substantially conform to a shape to accommodate a kick portion and/or arch portion to which the deck is either moulded to when initially formed, or subsequently moulded or bonded to. Additionally or alternatively, a skin may be formed around the deck the action of heat.

Another aspect of the present invention provides a deck for a traction pad for a water board, the deck comprising raised portions protruding from an upper side or surface of the deck, in use, by a protrusion height relative to the upper surface, at least some of the raised portions including a higher portion and a lower portion, the protrusion height of the higher portion being greater than the protrusion height of the lower portion around the respective raised portion; a proportion of the raised portions in a first region of the upper surface have the respective higher portion located towards at least a left direction, in use, on the respective raised portion; a proportion of the raised portions in a second region of the upper surface have the respective higher portion located towards at least a forwards direction, in use, on the respective raised portion; a proportion of the raised portions in a third region of the upper surface have the respective higher portion located towards at least a right direction, in use, on the respective raised portion.

Another aspect of the present invention provides a traction pad for a water board, the traction pad having: first and second opposing surfaces, the first surface being fixed to the water board in use, the second surface being a contoured surface; at least first, second, third and fourth edges, the first edge being angled at less than 30 degrees to the third edge, the second and fourth edges being angled at less than 30 degrees to each other and being angled at more than 60 degrees from the first and third edges; raised portions protruding from the contoured surface by a protrusion height relative to the contoured surface, at least some of the raised portions including a higher portion and a lower portion, the protrusion height of the higher portion being greater than the protrusion height of the lower portion; wherein a proportion of the raised portions in at least a first region of the contoured surface have the respective higher portion located on the respective raised portion nearer the first edge of the traction pad than the third edge of the traction pad (or located on the respective raised portion, towards the first edge of the traction pad); a proportion of the raised portions in at least a second region of the contoured surface have the respective higher portion located on the respective raised portion nearer the second edge of the traction pad than the fourth edge of the traction pad.

For example, the first surface may be a base of the traction pad. A user may interact with the contoured surface during use. The second surface may be a baseline surface of an upper or grip surface, the baseline surface being contoured over any kick and/or arch features of the traction pad, the raised portions projecting from the baseline surface. The contoured surface may be inclined relative to the first surface in at least a kick region. The first, second, third and fourth edges of the traction pad may be a front, right, back and left edge respectively, relative to the water board, in use.

Another aspect of the present invention provides a traction pad for a water board, the traction pad having: first and second opposing surfaces, the first surface being fixed to the water board in use, the second surface being a contoured surface; raised portions protruding from the contoured surface by a protrusion height, the protrusion height being relative to the contoured surface; a proportion of the raised portions in at least a first region of the contoured surface being angled such that the protrusion height of the raised portion is higher towards a left side of the traction pad in use; a proportion of the raised portions in a second region of the contoured surface are angled such that the protrusion height of the raised portion is higher towards a front side of the traction pad in use; and a proportion of the raised portions in a third region of the contoured surface are angled such that the protrusion height of the raised portion is higher towards a right side of the traction pad in use.

The contoured surface may be on the side of the traction pad with which a user of the water board interacts, in use. The contoured surface may be inclined relative to the first surface in at least a kick region.

Another aspect of the present invention provides a traction pad for a water board, the traction pad having: first and second opposing surfaces, the first surface being fixed to the water board in use, the second surface being a contoured surface; raised portions protruding from the contoured surface by a protrusion height relative to the contoured surface, at least some of the raised portions including a higher portion and a lower portion, the protrusion height of the higher portion being greater than the protrusion height of the lower portion; a proportion of the raised portions in at least a first region of the contoured surface have the respective higher portion located in a left direction in use on the respective raised portion; a proportion of the raised portions in at least a second region of the contoured surface have the respective higher portion located in a forwards direction in use on the respective raised portion; and a proportion of the raised portions in at least a third region of the contoured surface have the respective higher portion located in a right direction in use on the respective raised portion.

For example, the first surface may be a base of the traction pad. The contoured surface may be on the side of the traction pad with which a user of the water board interacts, in use. The contoured surface may be inclined relative to the first surface in at least a kick region. The proportion of the raised portions in each of the first, second and third regions may be at least ten percent, preferably at least fifteen percent, more preferably at least twenty percent and most preferably at least twenty-five percent, but may be at least thirty five percent or at least forty-five percent. The protrusion height of respective raised portion may be measured relative to the contoured surface around the respective raised portion or measured from a respective virtual surface contiguous with the contoured surface and through which the respective raised portion has protruded by the protrusion height.

The proportion of the raised portions in the first region of the contoured surface having the respective higher portion located towards at least a left direction, in use, on the respective raised portion, may be at least twenty-five percent, and at least twenty-five percent of the raised portions in the first region of the contoured surface may have the respective higher portion located towards at least a forwards direction, in use, on the respective raised portion.

At least twenty-five percent of the raised portions in the first region of the contoured surface have the respective higher portion located towards at least a forwards-left direction, in use, on the respective raised portion. For example, in the first region, the at least twenty-five percent of the raised portions having higher portions located in the forwards-left direction may include some or all of the at least twenty-five percent of raised portions having higher portions located in the left direction and/or may include some or all of the at least twenty-five percent of raised portions having higher portions located in the forwards direction. Alternatively, the at least twenty-five percent of the raised portions having higher portions located in the forwards-left direction may be in addition to the at least twenty-five percent of raised portions having higher portions located in the left direction and the at least twenty-five percent of raised portions having higher portions located in the forwards direction.

Alternatively, at least forty-five percent of the raised portions in the first region of the contoured surface may have the respective higher portion located towards a forwards-left direction, in use, on the respective raised portion.

The proportion of the raised portions in the first region of the contoured surface having the respective higher portion located towards at least a left direction, in use, on the respective raised portion, may be or may include some or a lesser proportion of raised portions which are located towards a forwards-left direction, said proportion being at least twenty-five percent.

Said lesser proportion may be at least ten percent, so in that case only ten percent of raised portions in the first region may have their higher point located towards a forwards-left direction. However, if all the proportion of raised portions in the first region are located towards the forwards-left direction, then at least twenty-five percent of the raised portions in the first region would have their higher point located towards a forwards-left direction.

Additionally, at least twenty-five percent of the raised portions in the first region of the contoured surface may have the respective higher portion located towards a backwards-right direction, in use, on the respective raised portion. Raised portions having the respective higher portion located towards the backwards-right direction may alternate with raised portions having the respective higher portion located towards the forwards-left direction over at least a portion of the first region.

Alternatively, at least twenty-five percent of the raised portions in the first region of the contoured surface may have the respective higher portion located towards a backwards-left direction, in use, on the respective raised portion. Alternatively, at least twenty-five percent of the raised portions in the first region of the contoured surface may have the respective higher portion located towards a forwards-right direction, in use, on the respective raised portion.

The proportion of the raised portions in the third region of the contoured surface having the respective higher portion located towards at least a right direction, in use, on the respective raised portion, may be located towards a forwards-right direction, said proportion being at least twenty-five percent. At least twenty-five percent of the raised portions in the third region of the contoured surface may have the respective higher portion located towards a backwards-left direction, in use, on the respective raised portion.

The proportion of the raised portions in the second region of the contoured surface having the respective higher portion located towards at least a forwards direction, in use, on the respective raised portion, may be at least twenty-five percent.

At least twenty-five percent of the raised portions in the second region of the contoured surface may have the respective higher portion located towards at least a forwards-left direction, in use, on the respective raised portion. For example, in the second region, the at least twenty-five percent of the raised portions having higher portions located in the forwards-left direction may include some or all of the at least twenty-five percent of raised portions having higher portions located in the forwards direction. Alternatively, the at least twenty-five percent of the raised portions having higher portions located in the forwards-left direction may be in addition to the at least twenty-five percent of raised portions having higher portions located in the forwards direction.

A proportion of the raised portions in at least a fourth region of the contoured surface may have the respective higher portion located towards at least a forwards direction, in use, on the respective raised portion. Said proportion may be at least ten percent, preferably at least fifteen percent, more preferably at least twenty percent and most preferably at least twenty-five percent, but may be at least thirty five percent or at least forty-five percent.

The proportion of the raised portions in the fourth region of the contoured surface having the respective higher portion located towards at least a forwards direction, in use, on the respective raised portion, may be at least twenty-five percent. At least twenty-five percent of the raised portions in the second region of the contoured surface may have the respective higher portion located towards at least a forwards-right direction, in use, on the respective raised portion.

A proportion of the raised portions in a fourth region of the contoured surface may have the respective higher portion located towards at least a forwards direction, in use, on the respective raised portion. The first region may be located towards a left side of the pad (for example, left of a centre-line of the pad) and forward of a kick region. Or a centre of the first region may be left of an arch and forward of the kick. The second region may be located towards a front side and the left side of the pad (for example towards a front left corner of the pad). The third region may be located towards a right side of the pad (for example, right of a centre-line of the pad) and forward of a kick region. Or a centre of the third region may be right of an arch and forward of the kick. The fourth region may be located towards the front side and the right side of the pad (for example towards a front right corner of the pad). The second region may be a mirror of the first region. The fourth region may be a mirror of the third region. The mirrored regions may be mirrored about a centre-line of the traction pad.

Said proportion may be at least ten percent, preferably at least fifteen percent, more preferably at least twenty percent and most preferably at least twenty-five percent, but may be at least thirty five percent or at least forty-five percent.

The traction pad may be moulded. The traction pad may be moulded as a one-piece product. The traction pad may comprise separable moulded traction pad portions. Alternatively, the traction pad may be formed as individual traction pad portions that, in use, provide a traction pad surface.

Another aspect of the invention provides a deck for a traction pad as described in the preceding aspect of the invention, the deck including the second surface and the raised portions. The deck may be moulded into a contoured form to accommodate a kick and/or an arch.

Another aspect of the present invention provides a traction pad for a water board, the traction pad including a kick portion having an at least backwards facing surface, in use, wherein the kick portion includes back holes extending into the kick from the at least backwards facing surface.

At least a proportion of the back holes may extend within ten or within twenty degrees of longitudinal relative to the traction pad. The proportion may be at least thirty percent, least forty percent or at least fifty percent. Additionally, the kick portion may include side holes extending into the kick from an at least side facing surface, said side holes extending within ten or within twenty degrees of lateral relative to the traction pad. All, a proportion, or none of the side holes may be through-holes, for example extending into a slot.

At least a proportion of the back holes may extend at least fifty percent of a depth of the kick from the backwards facing surface to an at least forwards facing contoured surface. The proportion of the back holes may be ten, twenty, thirty, forty or fifty percent. Said proportion of holes may preferably extend (or have a depth of) at least sixty, seventy or eighty percent of a depth of the kick.

The kick portion may include, in use, an upper surface and a lower surface; the kick portion may include a slot extending substantially longitudinally in use from the at least backwards facing surface through the upper surface or through the lower surface; the slot may include a base portion forming an internal edge of the slot. The internal edge of the slot may be the edge furthest from the upper and lower surfaces or from said upper or from said lower surface.

The kick portion may be moulded. Alternatively or additionally, the traction pad may be moulded.

Another aspect of the present invention provides a traction pad for a water board, the traction pad including a kick portion having, in use, an at least backwards facing surface, an upper surface and a lower surface, wherein: the kick portion includes a slot extending substantially longitudinally in use from the at least backwards facing surface through the upper surface or through the lower surface; the slot including a base portion forming an internal edge of the slot. The internal edge of the slot may be the edge furthest from the upper and lower surfaces or from said upper or from said lower surface.

The base portion may have a base portion width which is greater than a width of the slot adjacent the base portion.

The kick portion may be moulded.

The kick portion may include back holes extending into the kick from the at least backwards facing surface. At least a proportion of the back holes may extend within ten or within twenty degrees of longitudinal relative to the traction pad. The proportion may be at least thirty percent, least forty percent or at least fifty percent.

At least a proportion of the back holes may extend at least fifty of a depth of the kick from the backwards facing surface to an at least forwards facing contoured surface. The proportion of the back holes may be ten, twenty, thirty, forty or fifty percent. Said proportion of holes may preferably extend (or have a depth of) at least sixty, seventy or eighty percent of a depth of the kick.

Another aspect of the present invention provides a kick portion for a traction pad, the kick portion having an at least backwards facing surface, in use, wherein the kick portion includes back holes extending into the kick from the at least backwards facing surface.

At least a proportion of the back holes may extend within ten or within twenty degrees of longitudinal relative to the traction pad. The proportion may be at least thirty percent, least forty percent or at least fifty percent. Additionally, the kick portion may include side holes extending into the kick from an at least side facing surface, said side holes extending within ten or within twenty degrees of lateral relative to the traction pad. All, a proportion, or none of the side holes may be through-holes, for example extending into a slot.

At least a proportion of the back holes may extend at least fifty percent of a depth of the kick from the backwards facing surface to an at least forwards facing contoured surface. The proportion of the back holes may be ten, twenty, thirty, forty or fifty percent. Said proportion of holes may preferably extend (or have a depth of) at least sixty, seventy or eighty percent of a depth of the kick.

The kick portion may include, in use, an upper surface and a lower surface; the kick portion may include a slot extending substantially longitudinally in use from the at least backwards facing surface through the upper surface or through the lower surface; the slot may include a base portion forming an internal edge of the slot. The internal edge of the slot may be the edge furthest from the upper and lower surfaces or from said upper or from said lower surface.

The kick portion may be moulded. Alternatively or additionally, the traction pad may be moulded.

Another aspect of the present invention provides a kick portion for a traction pad, the kick portion having, in use, an at least backwards facing surface, an upper surface and a lower surface, wherein: the kick portion includes a slot extending substantially longitudinally in use from the at least backwards facing surface through the upper surface or through the lower surface; the slot including a base portion forming an internal edge of the slot. The internal edge of the slot may be the edge furthest from the upper and lower surfaces or from said upper or from said lower surface.

The base portion may have a base portion width which is greater than a width of the slot adjacent the base portion.

The kick portion may be moulded.

The kick portion may include back holes extending into the kick from the at least backwards facing surface. At least a proportion of the back holes may extend within ten or within twenty degrees of longitudinal relative to the traction pad. The proportion may be at least thirty percent, least forty percent or at least fifty percent.

At least a proportion of the back holes may extend at least fifty of a depth of the kick from the backwards facing surface to an at least forwards facing contoured surface. The proportion of the back holes may be ten, twenty, thirty, forty or fifty percent. Said proportion of holes may preferably extend (or have a depth of) at least sixty, seventy or eighty percent of a depth of the kick.

DESCRIPTION OF PREFERRED EMBODIMENT

Throughout the specification, the use of the term water board can be understood to relate to any similar water-sports board or water recreation board, such as a body board, paddle board, windsurfer board, surfboard or other surf craft. Similarly, any description relating to a surfboard can equally relate to any similar water-sports board or water recreation board.

Figure 1:
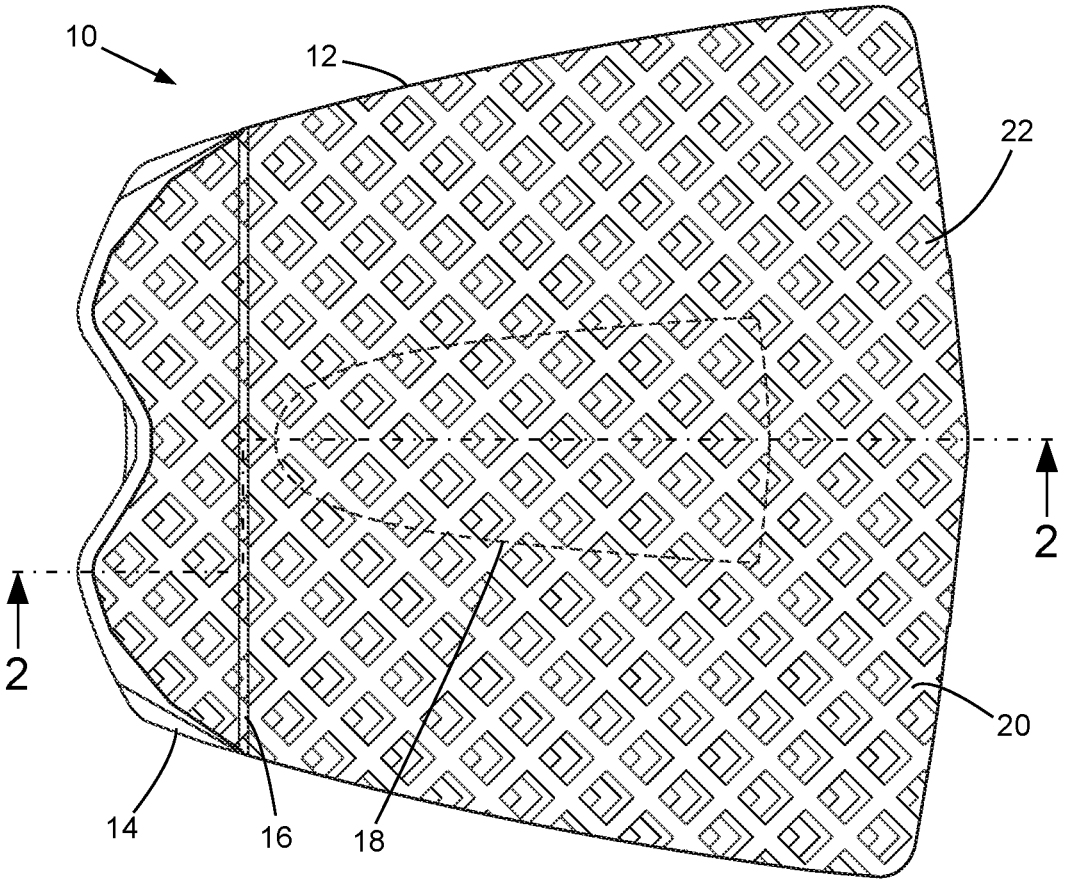
FIG. 1 is a top view of a prior traction pad.
Figure 2:
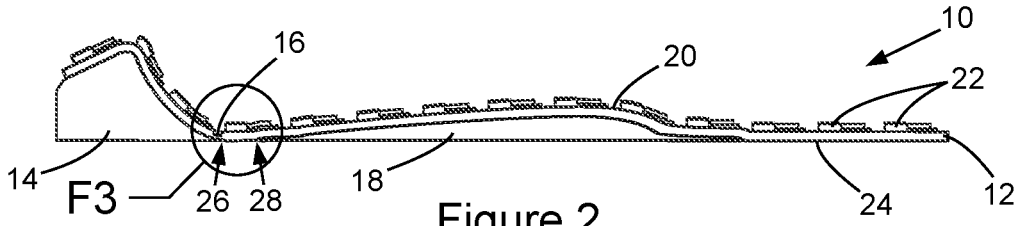
FIG. 2 is a section view through the traction pad of FIG. 1.

Referring initially to FIGS. 1 and 2, there is shown a traction pad 10 having a deck portion or deck sheet 12 bonded over a raised rear portion or kick 14 and optionally an arch 18. The section view in FIG. 2 is of a section cut along line F2 in FIG. 1. The deck sheet 12 has an upper surface 20 which is textured such as by the inclusion of raised portions or other texture features 22. These can be formed by cutting a pattern of grooves in the deck sheet. Where the deck sheet 12 is flexed at the base the kick 14, a groove 16 is provided in the upper surface 20 of the deck sheet 12 to assist the deck sheet to flex.

The deck sheet is manufactured as a flat sheet of material, usually bonded to the kick 14 and arch 18, then the traction pad 10 is stamped or die cut to shape. The lower surface 24 of the traction pad is usually substantially, but not perfectly flat. The flex or bends required for the deck sheet to contact the kick 14, the arch 18 and the top surface 42 of a surfboard 40 generate bending moments and residual stress in the deck sheet 12, kick 14 and arch 18, in the region indicated by F3 and shown enlarged in more detail in FIG. 3. This results in a gap 28 around the peripheral edge of arch 18 and a gap 26 at the front or leading edge of the kick 14. So even with the groove 16 cut in the deck sheet 12, the deck sheet 12 cannot flex to follow the top surface 42 of the surfboard 40 close the edge of the kick 14 and as the deck sheet 12 is bonded to the kick 14 before the traction pad is fixed to a surfboard 40, the edge of the kick is distorted by the bending loads in the deck sheet, generating the gap 26 at the front edge of the kick.

The adhesive layer 38 applied to the lower surface 24 of the traction pad is applied to the lower surface 34 of the kick 14, to the lower surface 36 of the arch 18, and to the portions of the lower surface 32 of the deck sheet 12 not bonded to the kick 14 and arch 18. When manufactured, the traction pad usually has a protective sheet below the adhesive layer 38. When the traction pad is installed onto a surfboard 40, the protective sheet is removed to expose the adhesive layer 38. The gaps 26 and 28 at the edges of the kick and arch can provide small areas of poor adhesion or no adhesion and/or air pockets between the traction pad and the top surface 42 of the surfboard 40.

Figure 4:
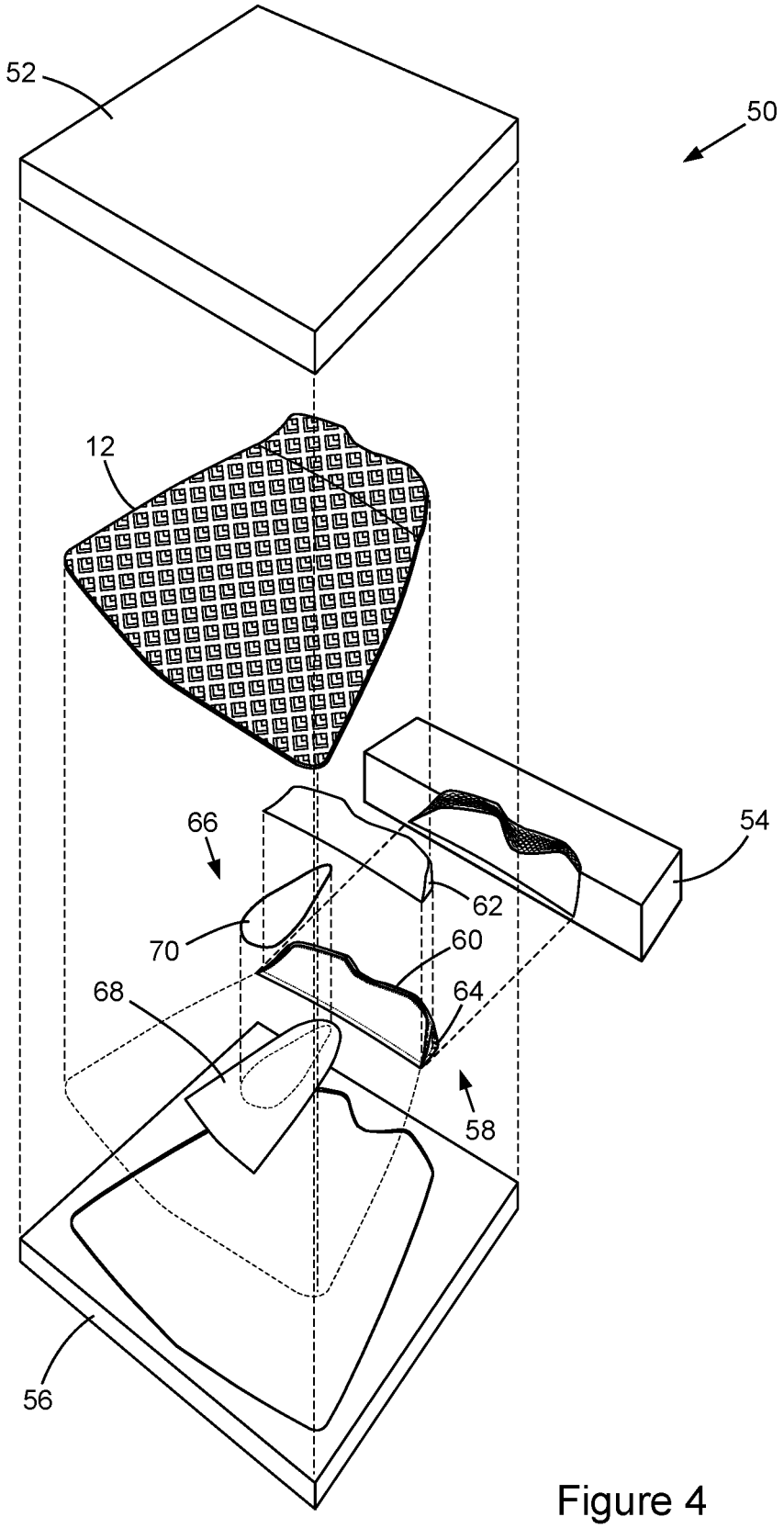
FIG. 4 is a perspective exploded view of a moulding arrangement for moulding a traction pad according to the present invention.

FIG. 4 shows a traction pad moulding arrangement 50. The upper mould 52 and the lower mould 56 allow the kick, arch and deck sheet to be moulded together using heat, at least in part, to bond them and to remove or significantly reduce the residual stress in the traction pad around the front edge of the kick and around the periphery of the arch. The use of heat can also provide a skin to the traction pad as the outer surfaces can be melted and such a skin can increase strength of the surface of the traction pad. Moulding can also add stiffness as well as strength to the traction pad and allow the use of more precision and complex shapes than are possible in mass production of die cut and bonded parts. The benefit of using a rear mould 54 in addition is that holes 64 or other features perpendicular to the mating direction of the upper and lower moulds can be formed in the kick.

In FIG. 4, the kick is a multi-stiffness kick 58 comprising a kick outer portion 60 at least partially surrounding at least one kick inner portion 62. Similarly, the arch is a multi-stiffness arch 66 comprising an arch base portion 68 and an arch upper portion 70. The at least two elements of each multi-stiffness kick or arch can be different materials, or regions of different density and stiffness material. For example, the kick inner portion can be a more aerated region of the kick, formed within a denser outer region of the same material. Alternatively, the kick inner portion and/or the arch top portion can be manufactured from a different stiffness material than the kick outer portion and/or the arch base portion. The different stiffness material can, for example, be a different (i.e., lower or higher) durometer urethane, a different durometer ethylene-vinyl acetate (EVA) or any different durometer non-petrochemical material. If an EVA or similar is used, an organic additive can be combined to the material mix to promote biodegradability when in a bacteria rich environment, as with other materials used in other elements of the traction pad.

Figure 5:
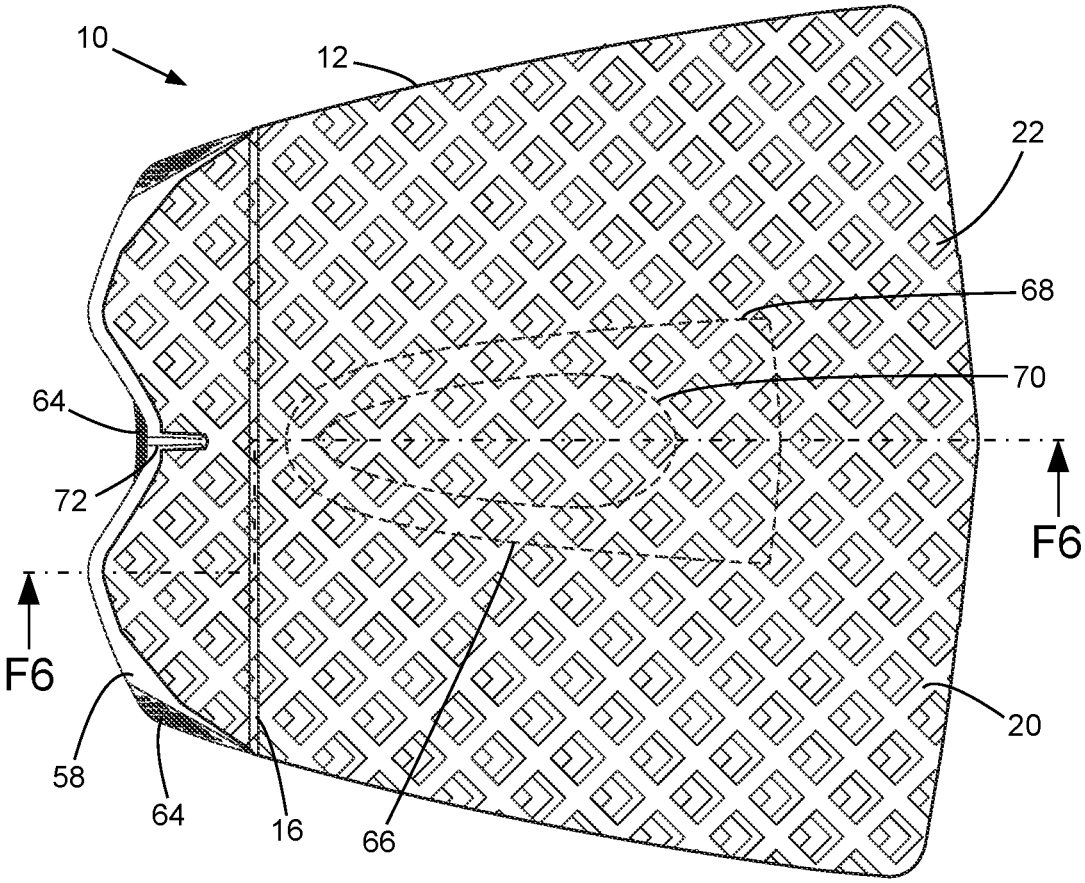
FIG. 5 is a top view of the traction pad of FIG. 4.
Figure 6:
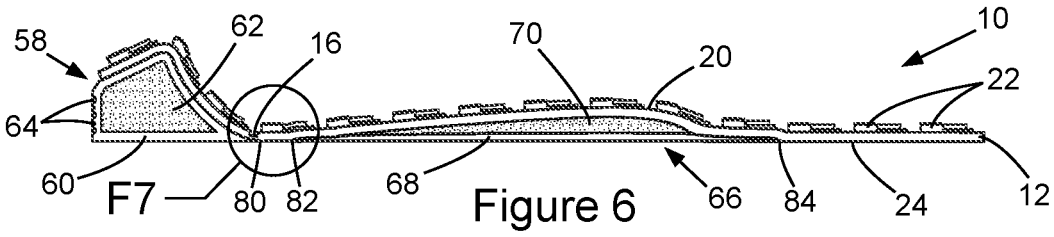
FIG. 6 is a section view through the traction pad of FIGS. 4 and 5.

The traction pad 10 shown in top view in FIG. 5 and in section view in FIG. 6 cut along the stepped section line F6 in FIG. 5 is similar to the traction pad in FIG. 4. The multi-stiffness arch 66 is shown in dashed lines in FIG. 5 as it is under the deck sheet 20, but the deck sheet will be curved over the arch 66. The outlines of the arch base portion 68 and the arch upper portion 70 are indicated.

The kick 58 includes a slot 72 in the top of its trailing edge, extending through the tallest portion of the kick to enable the kick to bend to conform to a curved top surface of a surfboard when fitted. If the kick is formed as a flat-bottomed part, the kick region of the traction pad can provide the majority of bend stiffness of the traction pad when viewed in a lateral plane. As most surfboards have a significant radius or curve to the top surface, when the traction pad is adhered to the top surface of the surfboard, the bending of the kick portion in particular to conform to the curve of the top of the surfboard can generate a residual stress in the traction pad, working against the adhesive action of the adhesive layer as the lateral edges of the kick portion of the traction pad. The slot 72 reduces the bending stiffness of the kick portion to significantly reduce the residual stress in the kick portion when adhered to a surfboard, in turn improving performance. This can negate the need for cutting the traction pad (more specifically at least the kick) into longitudinal strips or otherwise forming it in multiple parts as has been done previously. Alternatively, or in addition to the slot, the lower surface of the kick can be curved or otherwise contoured or shaped to at least partially match, conform to or accommodate the contour or curved top surface of the surfboard.

The slot 72 can be centrally located as shown in FIG. 5. Additionally or alternatively, slots can be provided laterally spaced from the longitudinal centre-line of the kick. For example, a similar slot can be provided through the longest portion of the kick, where the section line F6 passes with a matching slot provided symmetrically on the opposite side of the longitudinal centre-line of the kick. A kick incorporating slots of this type could be used in conventional bonded traction pad construction, but is most beneficially a moulded part or moulded into a traction pad as shown in FIG. 4.

The kick inner portion 62 can be seen located inside the different stiffness or durometer kick outer portion 60 in FIG. 6. Similarly, the arch upper portion 70 can be seen located above the arch base portion 68. The arch upper portion 70 is shown above the arch base portion 68 but can be partially or completely surrounded by material of the arch base portion. Similarly, the kick inner portion 62 is shown completely enclosed within the kick outer portion 60, but can be only above the kick outer portion or only partially enclosed by the kick outer portion.

The holes 64 in the rear and side faces of the kick outer portion 60 can be dimples that do not extend through the kick outer portion. Alternatively, some or all of the holes 64 in the rear and side faces of the kick outer portion 60 can penetrate completely through the kick outer portion to expose or even penetrate the kick inner portion 62.

The benefit of moulding the kick, arch and deck sheet together as shown in FIG. 4 is that the residual stress around the bending points of the deck sheet can be reduced or neutralised. These bending points on the lower surface 24 of the traction pad 10 are at the leading edge 80 of the kick and at the peripheral edge of the arch 66, such as at the trailing edge 82 of the arch 82 and the leading edge 84 of the arch in the section shown in FIG. 6.

Figure 7:
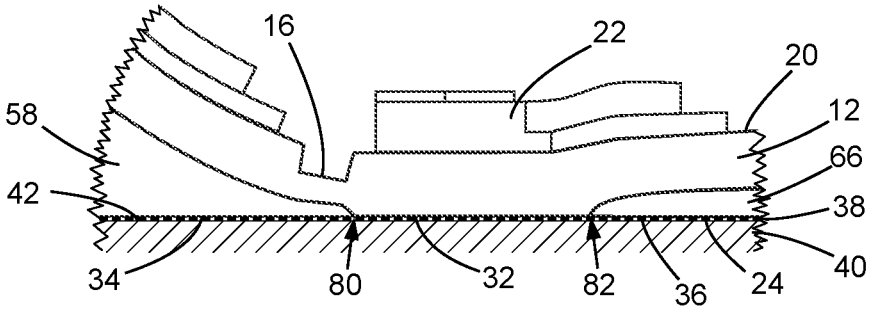
FIG. 7 is a detail from the section view of FIG. 6.

The groove 16 is shown provided in the deck sheet 20 near the leading edge 80 of the kick 58 to assist with reducing the residual stress in the deck sheet where it is most flexed. Detail of this region indicated at F7 is shown in the enlarged view in FIG. 7. If the traction pad is moulded, for example as shown in FIG. 4, then as can be seen in FIG. 7, the lower surface 34 of the leading edge 80 of the kick 58 and the lower surface 32 of the deck sheet 12 are not significantly raised off the top surface 42 of the surfboard 40 where those lower surfaces 32, 34 meet. Similarly, the lower surface 36 of the trailing edge 82 of the arch 66 and the lower surface 32 of the deck sheet 12 are not significantly raised off the top surface 42 of the surfboard 40 where those lower surfaces 32, 36 meet. If a small gap is still present at the edges 80, 82 between the lower surface 32 of the deck sheet and the lower surface 34, 36 of the kick 58 or arch 66, then such a gap is preferably less than 1.5 mm in height, preferably less than 0.8 mm or preferably less than 0.5 mm and more preferably less than 0.3 mm, most preferably less than 0.2 mm or less than 0.1 mm. This height of gap is essentially a height variance over a distance of less than 10 mm, preferably less than 5 mm along the pad lower surface 24. A small gap with lower residual stress than the conventional bonding method of construction provides improved adhesive performance of the traction pad.

Alternatively, a groove could be cut into the leading edge of the kick or into the traction pad (kick and/or deck sheet) at the leading edge of the kick to provide a larger height gap to form a hard-edged channel to allow water to pass. This can prevent minor lift at the edges of the adhesive regions which if not prevented, can increase in size with time. Similarly, holes can be cut through the flat parts of the pad without causing water lifting as the holes does not generate residual stress and as a result can be hard edged. However too many holes can weaken the deck sheet and reduce the adhesive area.

Figure 8:
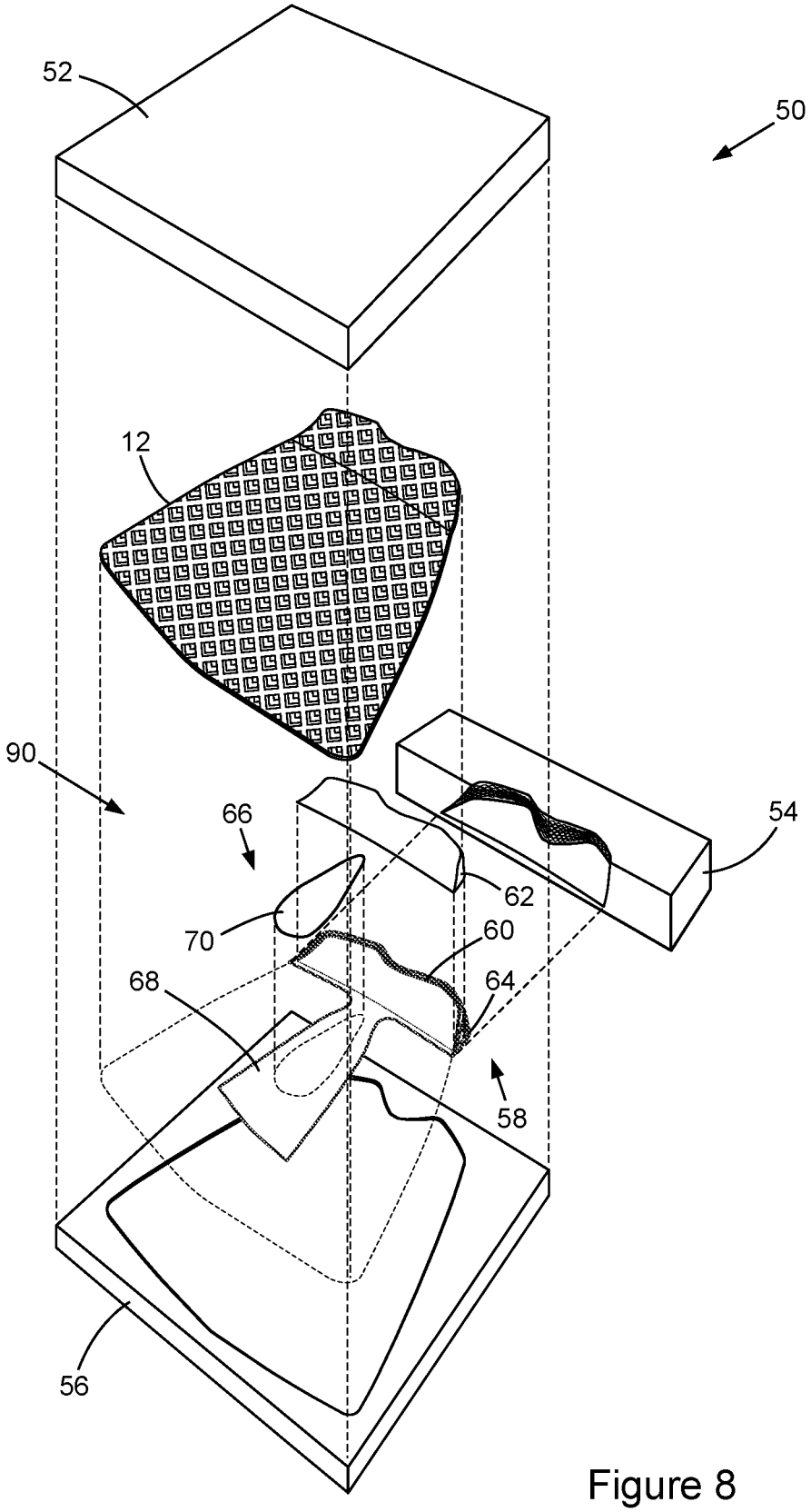
FIG. 8 is a perspective exploded view of a moulding arrangement for moulding a traction pad including a combined kick and arch according to the present invention.

The traction pad moulding arrangement 50 shown in FIG. 8 is similar to that shown in FIG. 4, but the kick 58 and arch 66 are joined together in a combined kick and arch 90. The combined kick and arch 90 can be formed as a single generally T-shaped part, or as shown, can be formed by combining the kick outer portion 60 and the arch base portion 68, allowing a multi-stiffness kick and/or arch to be used.

Figure 9:
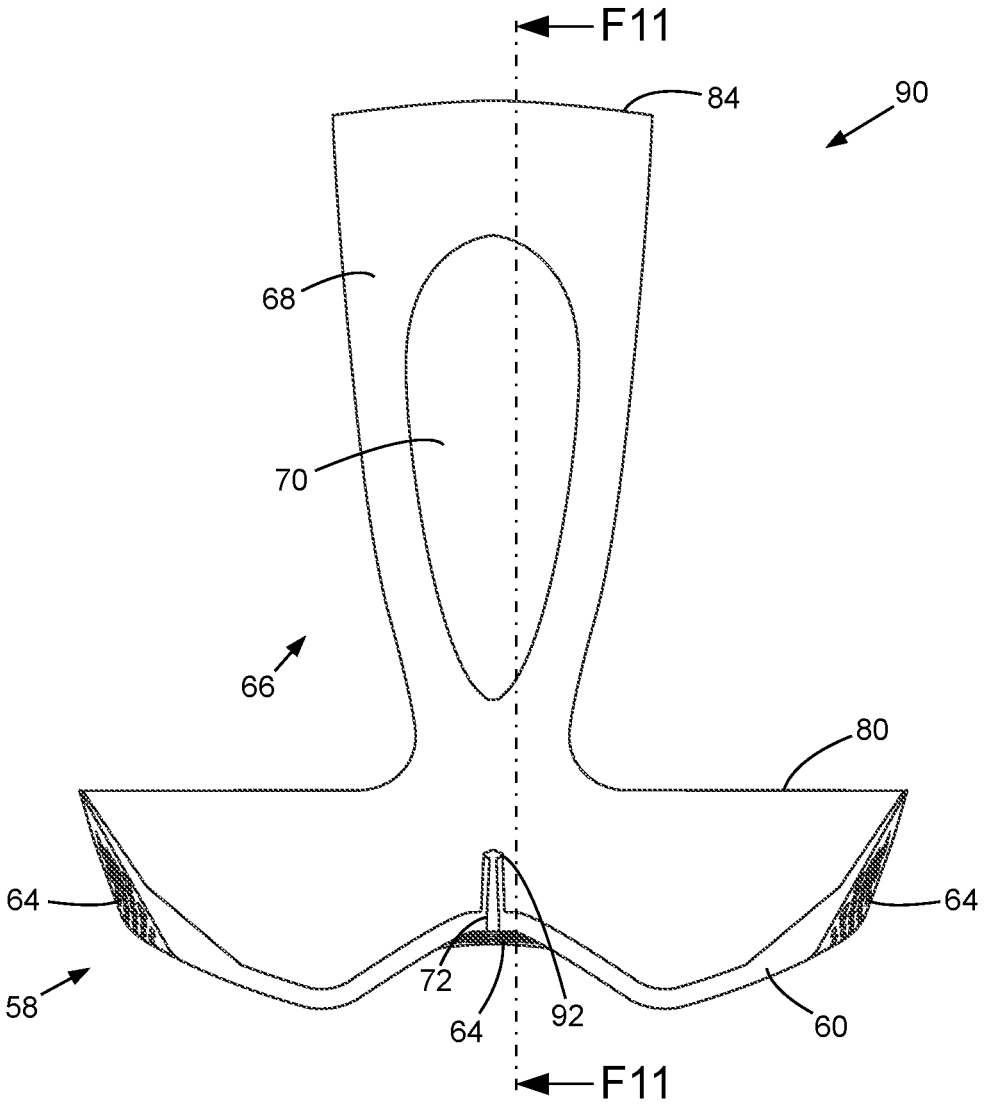
FIG. 9 is a top view of a combined kick and arch according to the present invention.

FIG. 9 shows the combined kick and arch 90. In this example, the arch base portion 68 extends forward from the leading edge 80 of the kick outer portion 60. The slot 72 in the top of the kick includes a front edge 92 shaped to provide strength at the end of the slot to discourage tearing from the edge of the slot forward into the kick. The lower edge 94 or base of the slot 72 can be similarly shaped as shown in FIG. 10.

Figure 3:
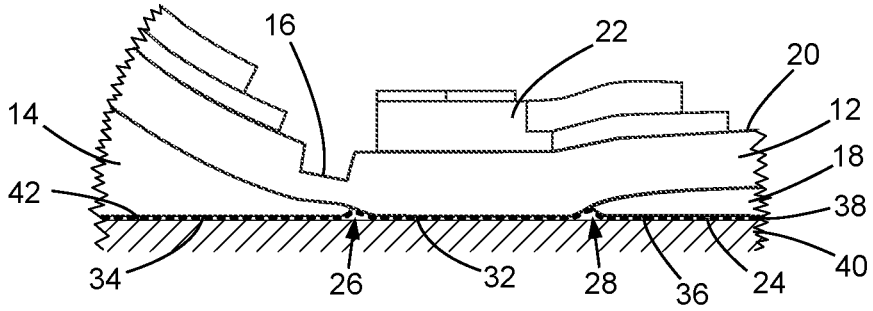
FIG. 3 is a detail from the section view of FIG. 2
Figure 10:
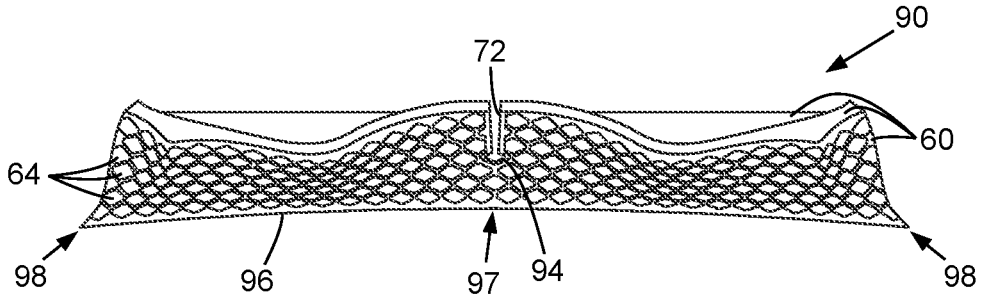
FIG. 10 is a rear view of the combined kick and arch of FIG. 9.

In addition to, or as an alternative to the slot 72, the lower surface of the kick is preferably a concave curved lower surface 96 as shown in FIG. 10 to approximate the convex curve of the top surface of a surfboard and assist the traction pad to conform to the required shape to adhere to the surfboard with minimal residual stress when installed. For example, the centre 97 of the curved surface 96 can typically need to be 2 mm higher than the outer edges 98 for the concave underside or curved lower surface 96 of the kick to match the convex curve on the top of a surfboard. Such a contoured or concave curved lower surface 96 of the kick can be applied to the separate kick of other traction pad arrangements such as those shown in FIGS. 4 to 7 and can also be applied to modify the design of conventional traction pads such as shown in FIGS. 1-3.

Figure 11:
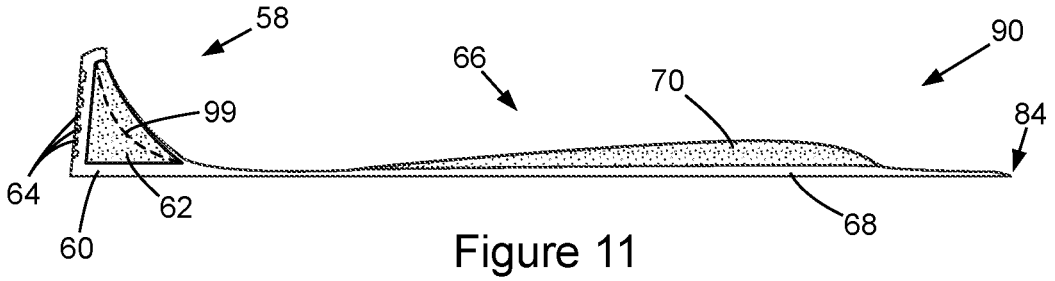
FIG. 11 is a section view through the combined kick and arch of FIG. 9.

FIG. 11 shows a section through the combined kick and arch 90 cut along the line F11 indicated in FIG. 9. As can be seen, the kick outer portion 60 and the arch base portion 68 are one piece, being integrated together. Also as shown in FIG. 11, the kick outer portion 60 does not wholly enclose the kick inner portion 62. Additionally, a boundary 99 is shown in the kick inner portion 62. This boundary 62 is a dotted line as it is optional, but indicates a possible boundary between different stiffness of material or different materials within the kick inner portion 62. For example, the kick inner portion and/or the arch upper portion can be formed from two or more constituent portions of different stiffness materials or from different materials. These constituent portions can simply be layers of materials, or as shown by the dashed line boundary 99 in FIG. 11, the constituent portions can be shaped and vary in thickness.

Figure 12:
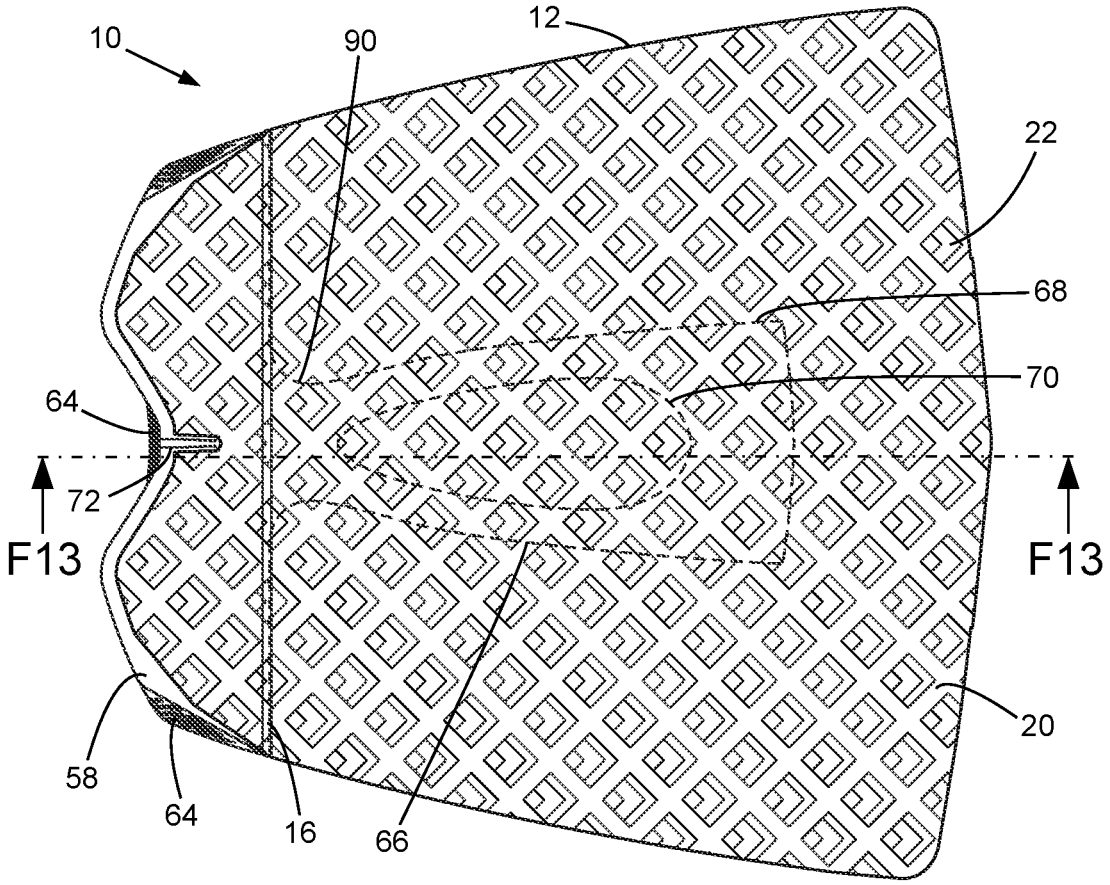
FIG. 12 is a top view of the traction pad of FIG. 8.

A traction pad incorporating the combined kick and arch 90 is shown in top view in FIG. 12, with the multi-stiffness arch 66 under the deck sheet 20 being shown in dotted lines and extending back to the kick 58. The section cut line F13 indicates the cut for the cross section shown in FIG. 13.

Figure 13:
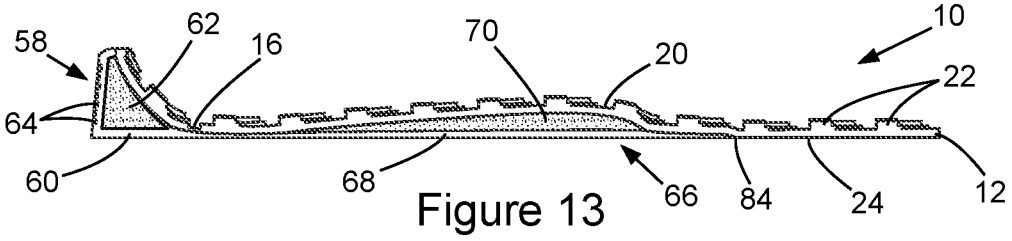
FIG. 13 is a section view through the traction pad of FIGS. 8 and 12.

The one-piece kick outer portion 60 and arch base portion 68 can be seen in the cross section in FIG. 13. While a groove 16 can still be provided in the deck sheet 12 to assist with the bending of the deck sheet to the form of the combined kick and arch 90 at the leading edge of the kick, the two edges of the kick and arch which were close to each other in the separate kick and arch embodiments shown in FIGS. 1 to 7 are eliminated in this section view. This further reduces the chance of the pad lifting in the region between the arch and the gradual lift due to poor adhesion with a surfboard when in use.

When moulding the traction pad, there can be more than one density of material being moulded together. For example, the density of the kick outer portion, the deck sheet and the arch base portion can be of a lower durometer than the kick inner portion. However, each portion can be of a different density and/or durometer from each other portion if required, or even made from material having variable stiffness, density and/or durometer, such as an arch upper portion having an aerated core around a denser outer skin. The deck sheet 12 can comprise multiple layers of different materials bonded or moulded together or can again include an aerated core within a denser, stronger skin.

Figure 13A:
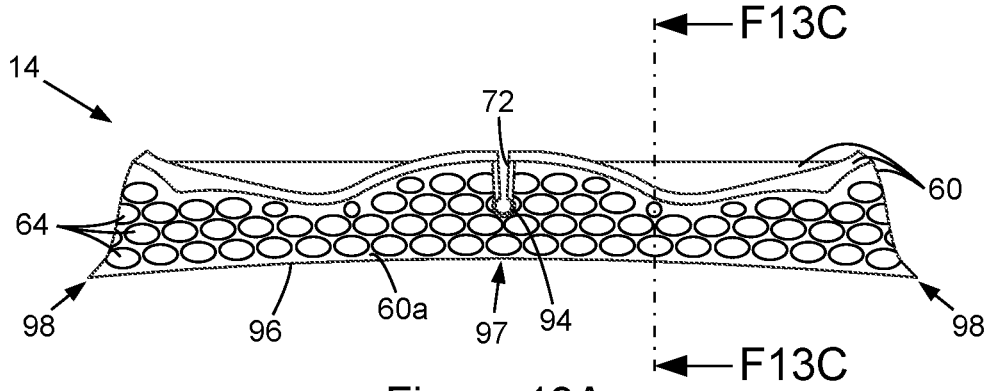
FIG. 13A is a rear view of a kick portion for a traction pad according to the present invention.

FIG. 13A shows a kick of another aspect of the invention, having the holes 64 in the backwards facing surface 60*a* of the kick 14 extending through a substantial portion of the kick. The addition of holes can be used to reduce the stiffness of the kick without needing to use multiple stiffness materials in the kick. Having the holes open to the rear of the kick prevents any water becoming trapped in the holes. Moulding the kick 14 with the holes 64 can provide significant strength and durability benefits compared to machining the kick from solid. The section line F13C indicates the line through which the section in FIG. 13C is cut. In FIG. 13C the depth of the holes 64 and the single material of the kick 14 is visible. Preferably the holes 64 do not pass through the contoured (and at least partially upwards facing) surface 59 of the kick 14.

In FIG. 13A, the holes are oval or round as opposed to the more diamond-shaped, shallower holes 64 in FIG. 10. Such shallow holes 64 as shown in FIG. 10 can be formed by fixing or moulding a mesh or perforated outer layer over a main body of the kick 14. Indeed, any perforated layer can be fixed, bonded or moulded to the main body of the kick, for example, in a contrasting colour material, to allow a pattern or image to be formed on the kick 14, particularly on the rear or backwards facing surface 60*a* of the kick. However, the diamond-shaped holes 64 in FIG. 10 can optionally be used with the significantly increased hole depths of FIG. 13C and on a kick without an arch attached. Preferably the shapes and orientations of the holes allow some degree of concertina effect as the kick is compressed.

Figure 13B:
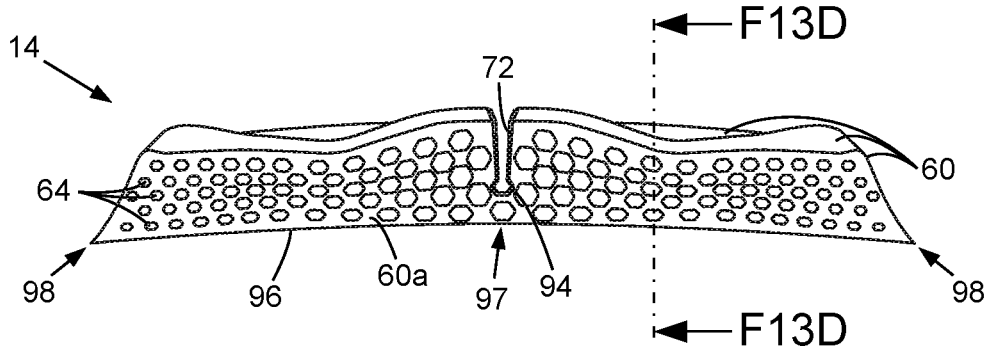
FIG. 13B is a rear view of a kick portion for a traction pad according to the present invention.
Figure 13C:
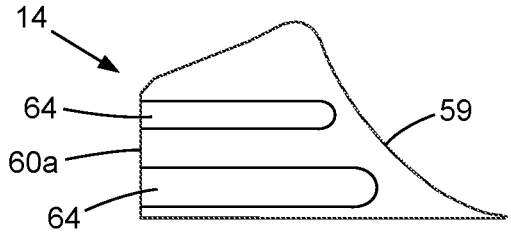
FIG. 13C is a section through the kick of FIG. 13A.
Figure 13D:
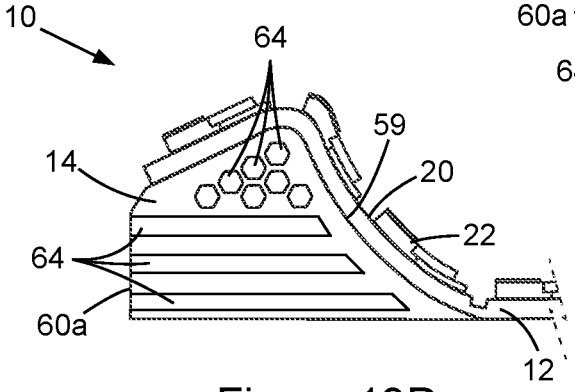
FIG. 13D is a section through the kick of FIG. 13B with the deck portion attached.

Other hole shapes are also envisaged such as the hexagonal holes in FIG. 13B and in the cross-sectional view of the kick region of a traction pad shown in FIG. 13D, the cut-line for the cross section being indicated by line F13D in FIG. 13B. While the depths of the holes extending from the backwards-facing surface 60*a* of the kick can be seen to remove a significant portion of material from the lower half of the kick if required for the desired stiffness properties, much of the upper half could remain solid. To provide additional holes in the top portion of the kick, holes 64 can extend laterally inwards from the outer sides of the kick as shown in FIG. 13D. These holes may or may not pass right though the upper half of the kick, through the slot 72 visible in FIGS. 13A and 13B.

In FIG. 10, the lower edge or base 94 of the slot 72 is a diamond shape, echoing the shape of the holes, although any shape could be used. For example, in FIG. 13A the lower edge or base 94 of the slot 72 is round or oval and in FIG. 13B the lower edge or base 94 of the slot 72 is hexagonal. Preferably in all cases however, the edges of the lower edge or base 94 of the slot 72 are reinforced such as by a small flange surrounding the base of the slot in the backwards facing surface 60*a* of the kick. As with the holes 64 into the kick, moulding the base of the slot can further improve the material properties and strength or resistance to tearing of the base of the slot in addition to the improvements from the shape alone. Moulding the kick 14 can also reduce material wastage, preventing the need for significant material removal to form the features of the kick, such as the holes 64 and the curvature of the curved lower surface 96.

Figure 14:
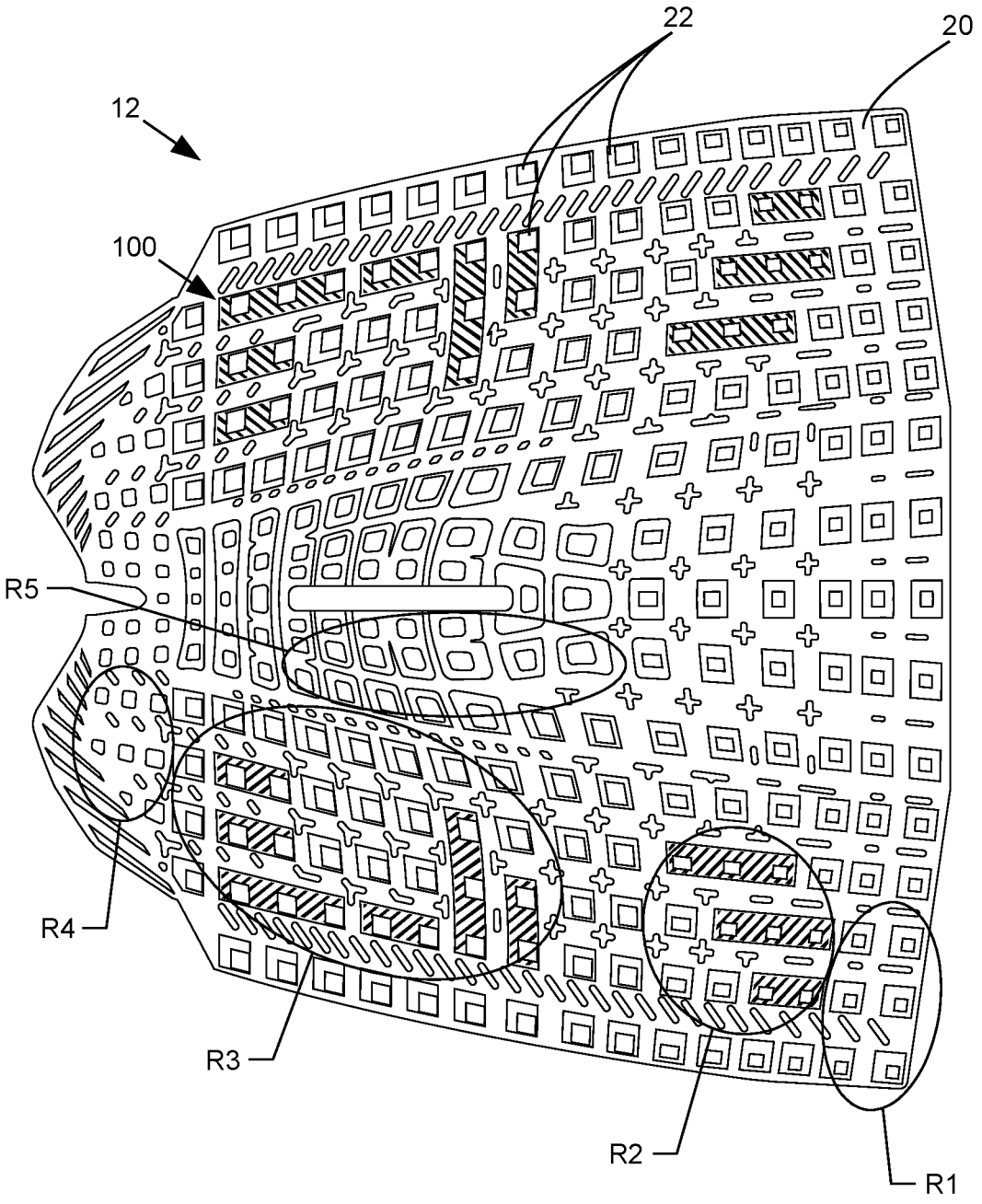
FIG. 14 is a top view of a traction pad with directional traction according to the present invention.

FIG. 14 shows a top view of a deck sheet 12 for a traction pad. As in FIGS. 1, 5 and 12, the deck sheet 12 has an upper surface 20 which is textured such as by the inclusion of raised portions or other texture features 22. The texture features 22 in the earlier Figures are shown as a regular pattern of raised portions which can be readily formed by machining. However, in FIG. 14, the texture features 22 or raised portions are irregular or not uniform across the deck sheet. Such irregular raised portions such as shown in FIG. 14 while still possible to machine, would be more complex to produce than more simple regular patterns and if machined would preferably be cut by computer numerically controlled (CNC) machines.

One benefit of using an irregular pattern of raised portions is that the raised portions can have higher portions that are different directions on different raised portions. This can allow the raised portions to be shaped to suit forces in different directions. Therefore, the raised portions shown in FIG. 14 can together be referred to as directional traction 100. As shown in FIG. 14, in a first region R1 towards the leading edge or front of the deck sheet 12, the raised portions are higher at least towards the front. The right-most raised portion in region R1 has its highest point towards the front and towards the right of the raised portion. In a second region R2, the raised portions are highest towards the right side of the raised portions. In a third region R3, the raised portions are heights towards the front and the raised portions nearer the right side of the deck sheet 12 are highest towards the right side as well as the front. A fourth region R4 is indicated in the kick area of the deck sheet and a fifth region R5 is indicated in the arch are of the deck sheet. Any number of such regions can be provided. Each region is typically an area which interacts with specific regions of the user's foot, such as the toes, ball, instep and heel, often with different regions of the user's foot depending on the user's stance on the traction pad.

Preferably, as shown in the following Figures and description, the directional traction 100 provides different regions of directional resistance. For example, the raised portions are typically individually lower towards the centre of the traction pad and higher towards the outer-facing edges of each raised portion. Also, in regions R2 and R3 are elongate raised portions having multiple higher portions on each for giving both toe and heel engagement regardless of stance.

Figure 15:
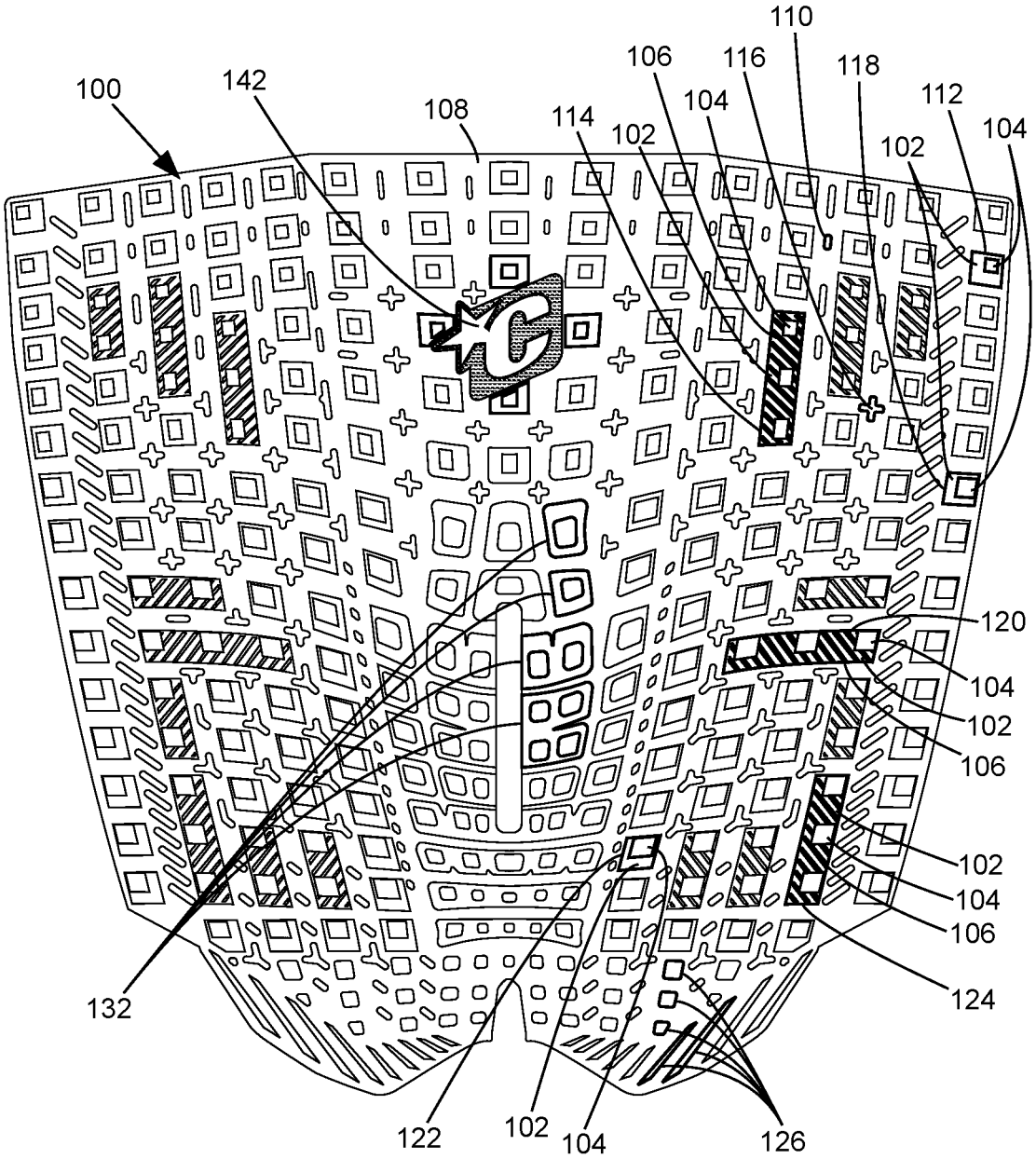
FIG. 15 is a top view of a traction pad with directional traction similar to that of FIG. 14.

FIG. 15 shows the deck sheet 12 of FIG. 14, but with a logo 142 incorporated into the raised portions of the directional traction 100 and with some raised portions shown in bold. Raised portion 110 is an approximately oval-shaped raised portion and can have an angled upper surface so that it is higher towards the front of the deck sheet, as are many of the other raised portions in the region indicated as R1 in FIG. 14. If the oval-shaped raised portion were in a different region it would preferably be angled in the direction preferred in that different region. The approximately square-shaped raised portions 112, 118 and 122 have stepped profiles in which the higher portions 104 are higher than (or thicker than) the lower portions 102 of the respective raised portion. The cross-shaped or X-shaped (in top view) raised portion 116 can have a similarly stepped profile or a curved or flat profile, preferably changing or tapering in height in the direction preferred in that region although it could change height in a different direction. It will be appreciated that the raised portions need not be stepped. The raised portions can be inclined between a lower portion and a higher portion. The raised portions can be stepped or inclined, or have a combination of step and incline, between the lower portions and the higher portions. Inclination can include tapering or sloping between a higher portion having a greater protrusion height than the lower portion relative to the contoured surface.

The lateral and longitudinal shaped raised portions 114, 120 and 124 incorporate grooves 106 in addition to the higher portions 104 and the lower portions 102. Each raised portion is raised above the deck sheet base thickness regions 108.

Figure 16:
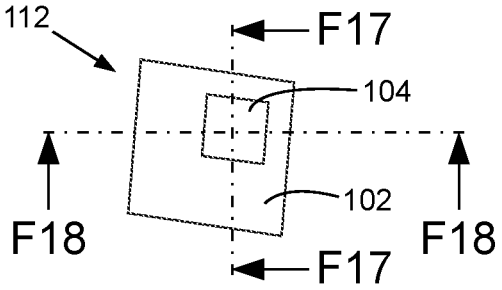
FIG. 16 is a top view of a raised portion of the traction pad of FIG. 15.
Figure 17:
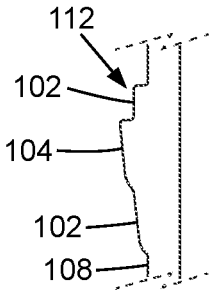
FIG. 17 is a section view through the raised portion of FIG. 16.
Figure 18:
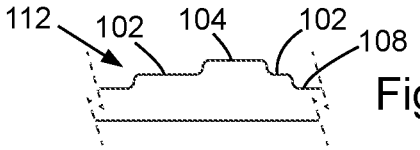
FIG. 18 is a section view through the raised portion of FIG. 16, taken perpendicular to the section of FIG. 17.

The approximately square-shaped raised portion 112 is shown enlarged in FIG. 16, with the profile in the longitudinal plane indicated at F17 in FIG. 16 being shown in FIG. 17 and with the profile in the lateral plane indicated at F18 in FIG. 16 being shown in FIG. 18. In FIG. 17, the lower portions 102 of the raised portion 112 can be seen to raise above the deck sheet base thickness regions 108, with the higher portion 104 being further raised. The higher portion 104 and the rearward region of the lower portion 102 are shown sloping upwards towards the front of the deck sheet. The higher portion 104 and the lower portion 102 can be seen in FIG. 18 to be substantially horizontal in a lateral direction, although either or both could also be angled, for example upwardly to the right as this raised portion 112 is located towards the right-hand edge of the deck sheet.

Figure 19:
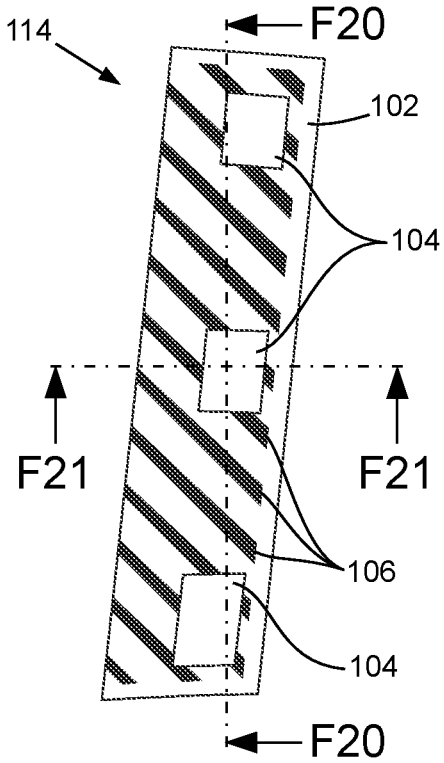
FIG. 19 is a top view of a raised portion of the traction pad of FIG. 15.
Figure 20:
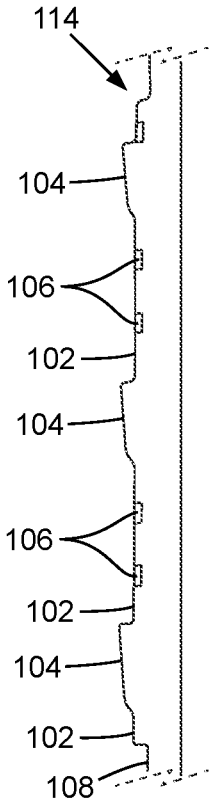
FIG. 20 is a section view through the raised portion of FIG. 19.
Figure 21:
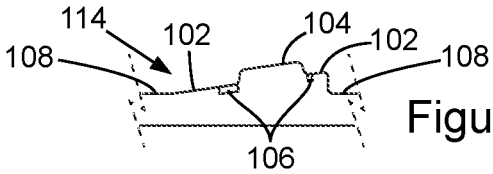
FIG. 21 is a section view through the raised portion of FIG. 19, taken perpendicular to the section of FIG. 20.

The primarily longitudinally oriented and approximately rectangular raised portion 114 of FIG. 15 is shown enlarged in FIG. 19 with longitudinal and lateral sections projected as indicated by section cut lines F20 and F21 from FIG. 19, into FIGS. 20 and 21. These Figures together show that the lower portion 102 of the raised portion 114 slopes upwardly from the left out of the deck sheet base thickness region 108, and that the three individual higher portions 104 each slope upwards towards the front. The grooves 106 in the lower portion 102 can also be seen in the lateral and longitudinal section views.

Figure 22:
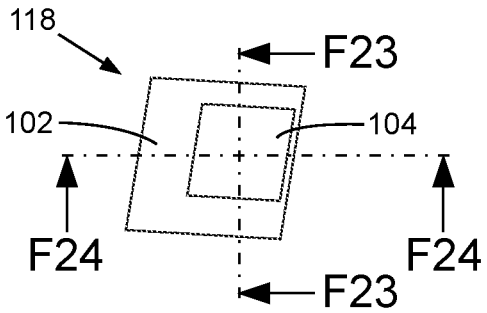
FIG. 22 is a top view of a raised portion of the traction pad of FIG. 15.
Figure 23:
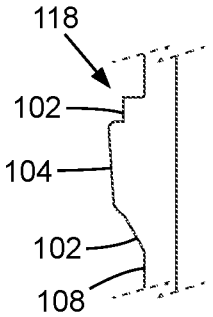
FIG. 23 is a section view through the raised portion of FIG. 22.
Figure 24:
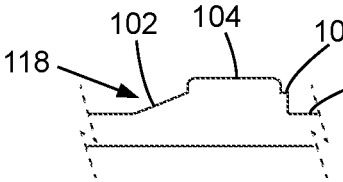
FIG. 24 is a section view through the raised portion of FIG. 22, taken perpendicular to the section of FIG. 23.

The approximately square-shaped raised portion 118 of FIG. 15 is shown enlarged in FIG. 22 with longitudinal and lateral sections projected into FIGS. 23 and 24 as indicated by section cut-lines F23 and F24 from FIG. 22. These Figures together show that the lower portion 102 of the raised portion 118 slopes upwardly out of the deck sheet base thickness region 108 from the left and from the back. The higher portion 104 is positioned towards the front and the right of the raised portion 118 and slopes slightly upwardly towards the front.

Figure 25:
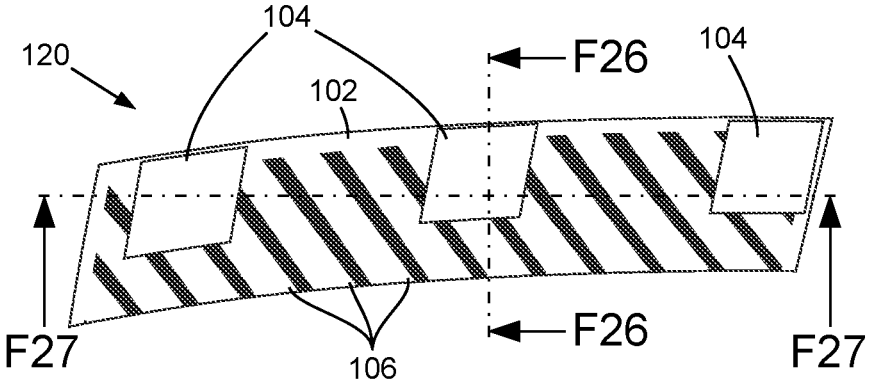
FIG. 25 is a top view of a raised portion of the traction pad of FIG. 15.
Figure 26:
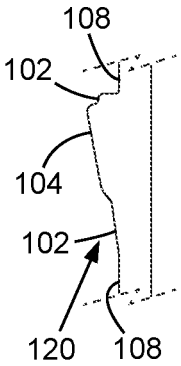
FIG. 26 is a section view through the raised portion of FIG. 25.
Figure 27:
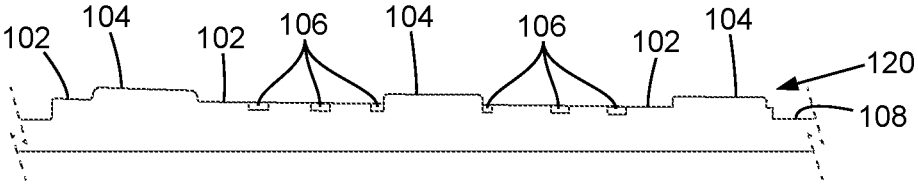
FIG. 27 is a section view through the raised portion of FIG. 25, taken perpendicular to the section of FIG. 26.

The primarily laterally oriented and approximately rectangular (being slightly curved in shape in top view) raised portion 120 of FIG. 15 is shown enlarged in FIG. 25 with longitudinal and lateral section views projected as indicated by section cut lines F26 and F27 from FIG. 25, into FIGS. 26 and 27. These Figures together show that the lower portion 102 of the raised portion 120 slopes upwardly out of the deck sheet base thickness region 108 from the back, being stepped above the deck sheet base thickness 108 on the left, right and front. The lower portion 102 also slopes slightly upwards towards the left as can be seen in FIG. 27. The three individual higher portions 104 each slope upwards towards the front as shown for the centre higher portion in FIG. 26. The grooves 106 in the lower portion 102 can also be seen in the lateral and longitudinal section views.

Figure 28:
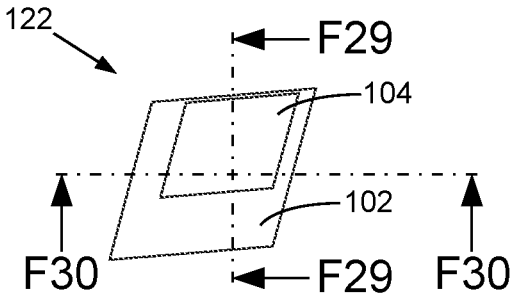
FIG. 28 is a top view of a raised portion of the traction pad of FIG. 15.
Figure 29:
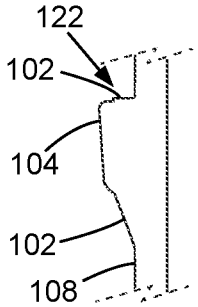
FIG. 29 is a section view through the raised portion of FIG. 28.
Figure 30:
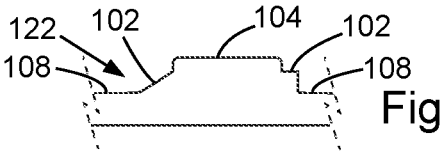
FIG. 30 is a section view through the raised portion of FIG. 28, taken perpendicular to the section of FIG. 29.

The approximately square-shaped raised portion 122 of FIG. 15 is shown enlarged in FIG. 28 with longitudinal and lateral sections projected into FIGS. 29 and 30 as indicated by section cut-lines F29 and F30 from FIG. 28. These Figures together show that the lower portion 102 of the raised portion 122 slopes upwardly out of the deck sheet base thickness region 108 from the left and from the back. up to the edges of the higher portion 104. The higher portion 104 is positioned towards the front and the right of the raised portion 122 and slopes slightly upwardly towards the front.

Figure 31:
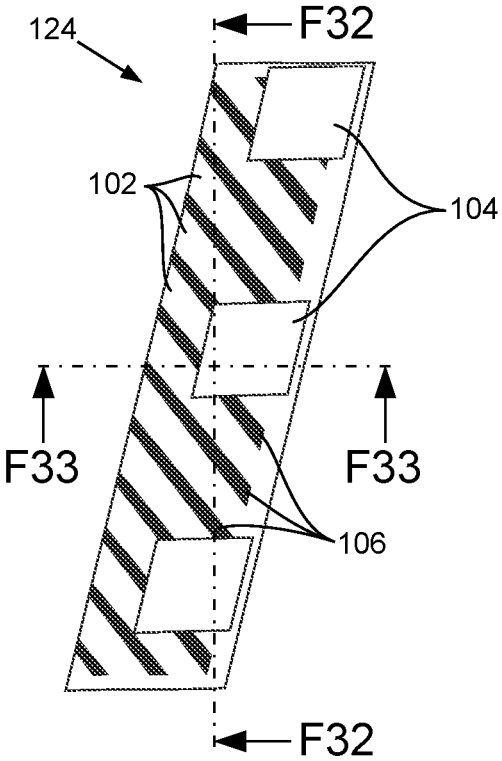
FIG. 31 is a top view of a raised portion of the traction pad of FIG. 15.
Figure 32:
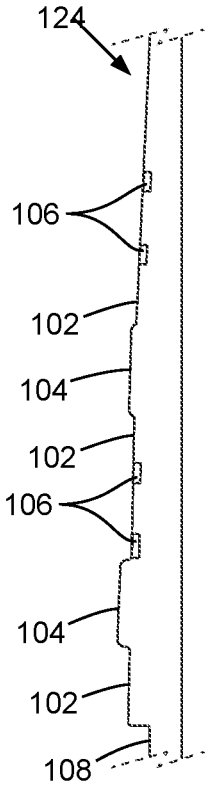
FIG. 32 is a section view through the raised portion of FIG. 31.
Figure 33:
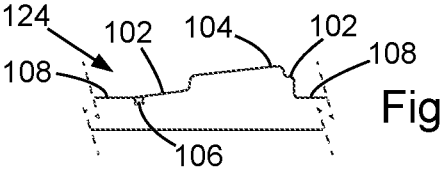
FIG. 33 is a section view through the raised portion of FIG. 31, taken perpendicular to the section of FIG. 32.

The primarily longitudinally oriented and approximately rectangular (or parallelogram shaped in top view) raised portion 124 of FIG. 15 is shown enlarged in FIG. 31 with longitudinal and lateral sections projected as indicated by section cut lines F32 and F33 from FIG. 31, into FIGS. 32 and 33. These Figures together show that the lower portion 102 of the raised portion 124 slopes upwardly at least from the left out of the deck sheet base thickness region 108, and that the three individual higher portions 104 each slope upwards at least towards the right. The grooves 106 in the lower portion 102 can also be seen in the lateral and longitudinal section views.

Figure 34:
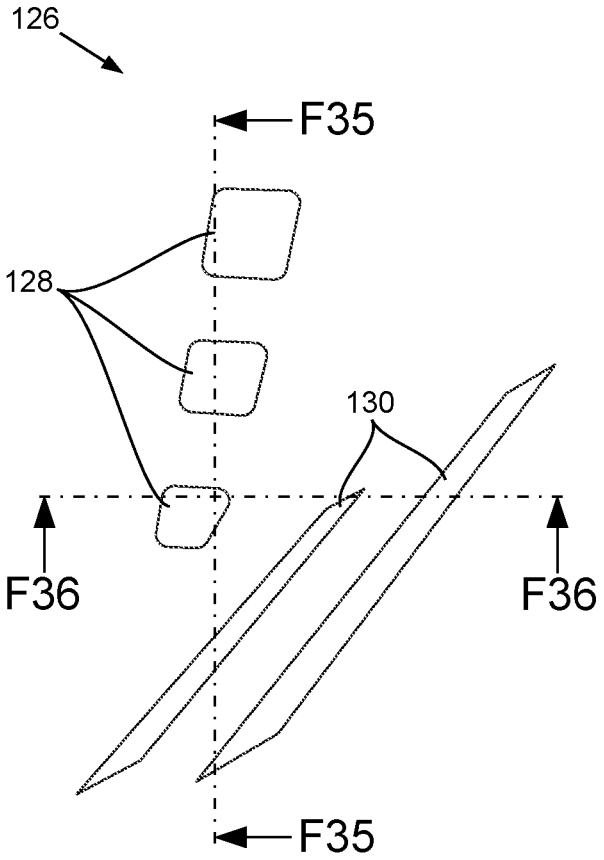
FIG. 34 is a top view of a raised portion of the traction pad of FIG. 15.
Figure 35:
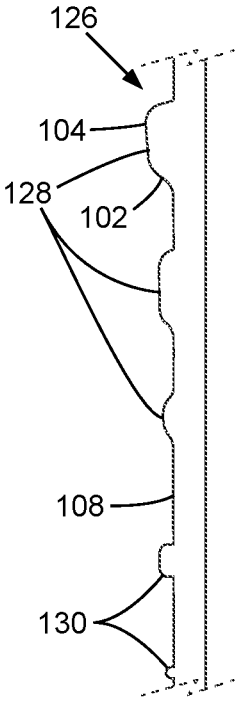
FIG. 35 is a section view through the raised portion of FIG. 34.
Figure 36:
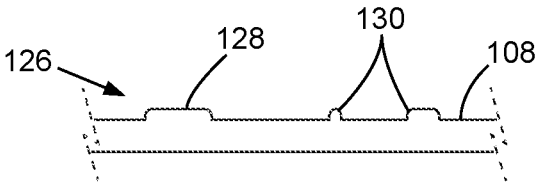
FIG. 36 is a section view through the raised portion of FIG. 34, taken perpendicular to the section of FIG. 35.

In FIG. 15, five raised portions 126 on the kick are shown in bold and this pattern of raised portions 126 is shown enlarged in FIG. 34. The longitudinal and lateral planes for the sectional views 35 and 36 are indicated by section lines F35 and F36 in FIG. 34 from which FIGS. 35 and 36 are projected. As FIGS. 34, 35 and 36 together show, the three approximately square-shaped raised portions 128 are raised above the deck sheet base thickness regions 108. These three raised portions 128 can have different profiles as shown, with in FIG. 35 the most forward of the three raised portions having a lower portion 102 that slopes upwards from the deck sheet base thickness region 108 to the edges of the higher portion 104. The higher portion further slopes upwards or is thicker towards the front. The other two approximately square-shaped raised portions 128 are flat-topped or substantially the same thickness inside the rounded edges that slope down to the deck sheet base thickness. The other two raised portions in FIG. 34 are elongate raised portions 130 which are shown as flat-topped, rounded corner bars of material raised above the deck sheet base thickness regions 108 as shown in FIGS. 35 and 36.

Figure 37:
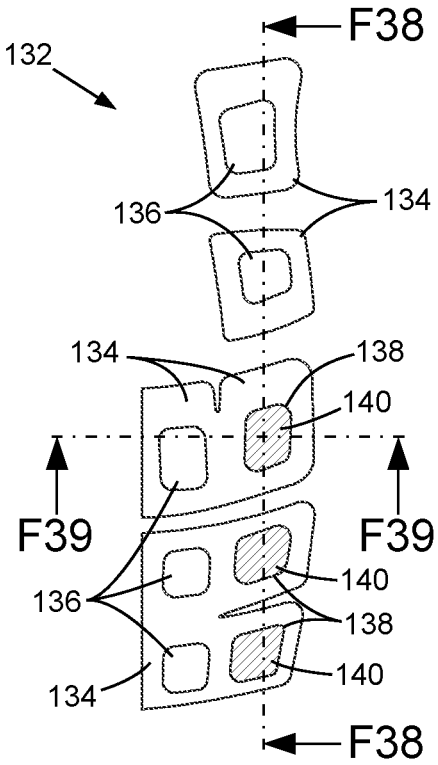
FIG. 37 is a top view of a raised portion of the traction pad of FIG. 15.
Figure 38:
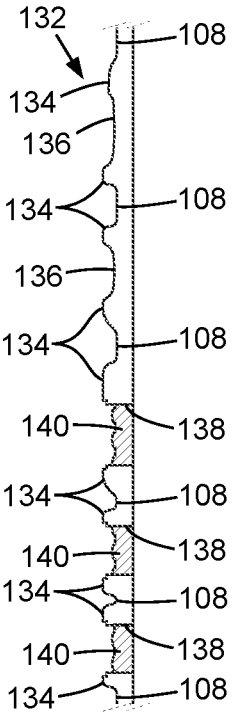
FIG. 38 is a section view through the raised portion of FIG. 37.
Figure 39:
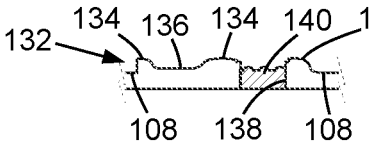
FIG. 39 is a section view through the raised portion of FIG. 37, taken perpendicular to the section of FIG. 38.

The pattern of raised portions 132 shown in bold in FIG. 15, and which lie on the on the arch in region R5 in FIG. 14, are shown enlarged in FIG. 37. The longitudinal and lateral planes for the sectional views 38 and 39 are indicated by section lines F38 and F39 in FIG. 34 from which FIGS. 38 and 39 are projected. The raised portions 132 rise in loops 134 from the deck sheet base thickness regions 108. The loops 134 of raised portion surround dimples 136 or holes 138. The edges of the raised portion loops 134 can have different profile from one side of the loop to the other, as shown in FIG. 38 where, for the front loop around a dimple 136, the leading edge of the loop slopes upwards towards the back and the trailing edge of the loop is higher and relatively level. For the adjacent loop, also around or forming a dimple 136, the leading edge of the loop is relatively high and level whereas the trailing edge of the loop slopes downwardly towards the back.

The hatching in FIGS. 37, 38 and 39 indicates regions of different material 140 in the holes 138 formed by some of the raised portion loops 134. This can be used to provide different colours to the centre regions inside the holes 138 of the raised portion loops 134. Preferably the different material 140 is a different stiffness, has a different friction characteristic, and/or has a different surface roughness or a patterned texture of dots, diamond shapes, or other shapes on the upper surface. While the different material 140 portions can be bonded in place, the preferred method of manufacture of a deck sheet with an irregular pattern of raised portions and incorporating different materials is moulding.

Figure 40:
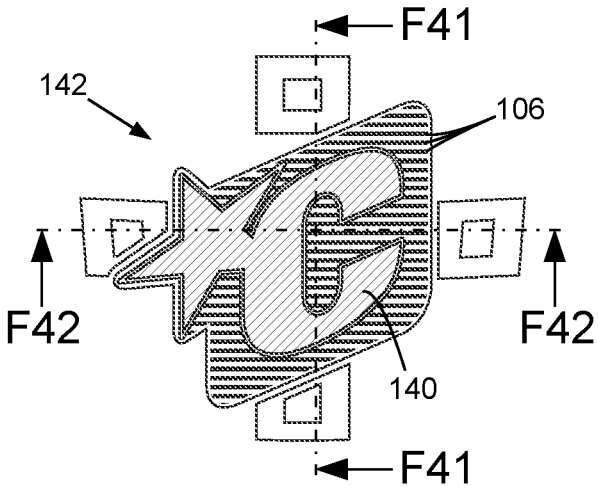
FIG. 40 is a top view of a raised portion of the traction pad of FIG. 15.
Figure 41:
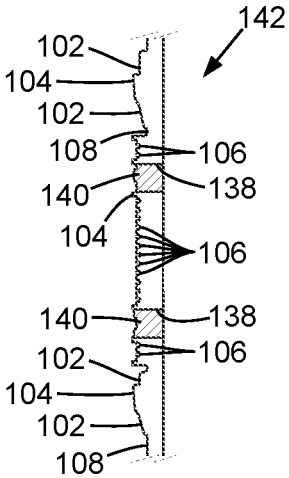
FIG. 41 is a section view through the raised portion of FIG. 40.
Figure 42:
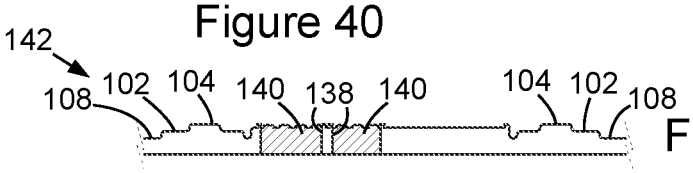
FIG. 42 is a section view through the raised portion of FIG. 40, taken perpendicular to the section of FIG. 41.

The branding or logo 142 shown in FIG. 15 is shown enlarged in FIG. 40. The longitudinal and lateral planes for the projected sectional views of FIGS. 41 and 42 are indicated by section lines F41 and F42 in FIG. 40. The features of grooves 106 and holes 138 at least partially filled with different material 140 can be used as shown to provide feature and definition for a logo 142.

Moulding the deck sheet 12 allows for a complex irregular pattern of raised portions and will provide reliable joining of different materials, but also allows the profile of the deck sheet to be moulded to suit the kick and arch. For example, the mould for the deck sheet can include the angle of the kick and the profile of the arch to minimise residual stress in the deck sheet when forming part of the traction pad. A sharp or well-defined edge can be formed at the leading edge of the kick portion, i.e., where the underside of the deck is angled upwards. The moulded deck sheet can be bonded to the kick and/or arch with minimal gaps as discussed in relation to FIG. 7. As discussed in relation to FIGS. 4 to 7, the whole traction pad 10 can be assembled by moulding to minimise residual stress in the traction pad and improve adhesion performance when the traction pad is installed on a water sports board. The underside of the traction pad can be concave to more readily mate to the water-sports board upon installation as discussed above. Similarly, the moulded traction pad can include a vertical slot 72 in the trailing edge of the kick.

The irregular pattern of raised portions can be more complex than some of the raised portions in a region such as region R3 having their higher portions located towards a forwards and/or a right direction. For example, some of the raised portions in a region can have their higher portions located towards a forwards direction, some of the raised portions in the region can have their higher portions located towards a right direction, some of the raised portions in the region can have their higher portions located towards a backwards direction and some of the raised portions in the region can have their higher portions located towards a left direction, or any combinations thereof.

Figure 43:
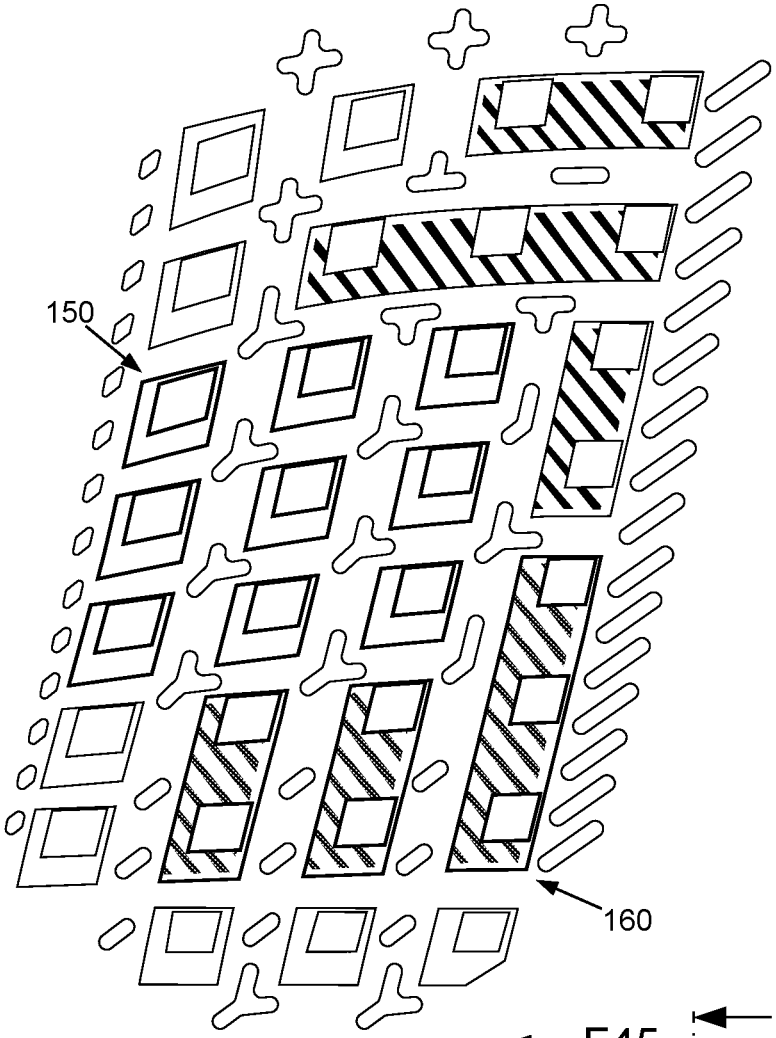
FIG. 43 is a top view of a region of the raised portions on the deck sheet.
Figure 44:
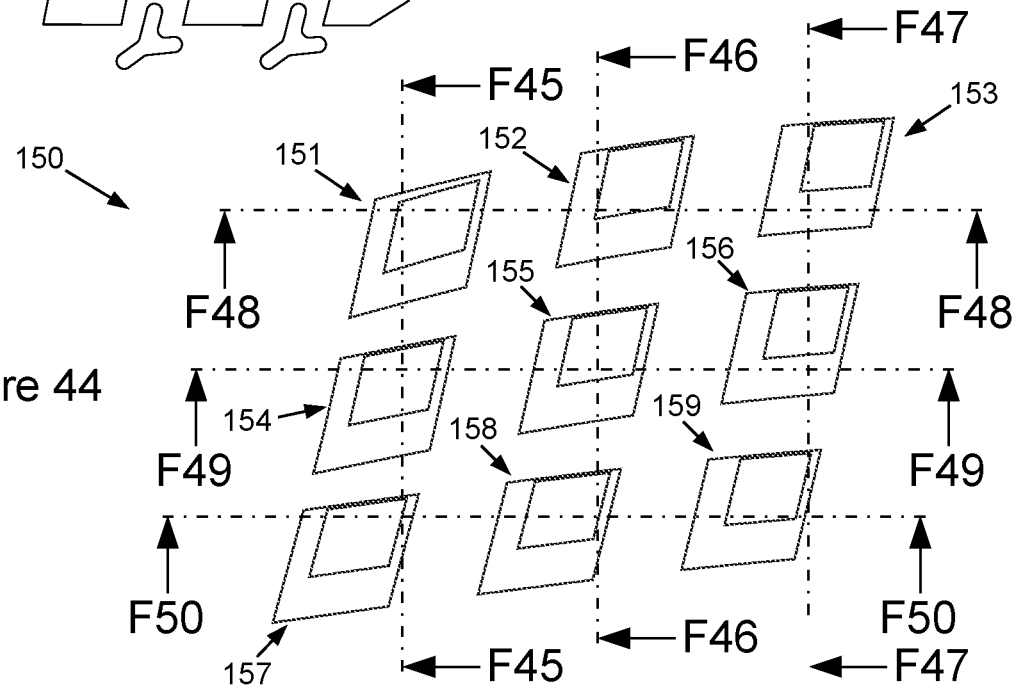
FIG. 44 shows a group of nine raised portions from FIG. 43.

FIG. 43 shows the raised portions of the region R3 from FIG. 14. The three-by-three pattern of raised portions 150 of FIG. 43 is shown in isolation in FIG. 44, with respective section lines F45, F46, F47, F48, F49 and F50 showing the origin of the sections shown in the respective FIGS. 45, 46, 47, 48, 49 and 50. The individual raised portions 151, 152, 153, 154, 155, 156, 167, 168, 159 are individually referenced in FIG. 44 to add clarity to FIGS. 45 to 50. The three bars or substantially longitudinally oriented rectangular raised portions 160 of FIG. 43 are shown in isolation in FIG. 51.

Figure 45:
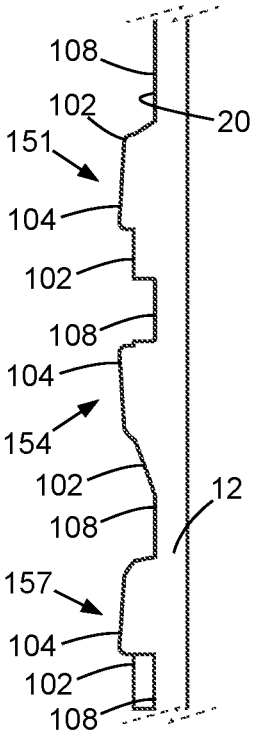
FIGS. 45 to 50 are sections views through the raised portions of FIG. 44.
Figure 46:
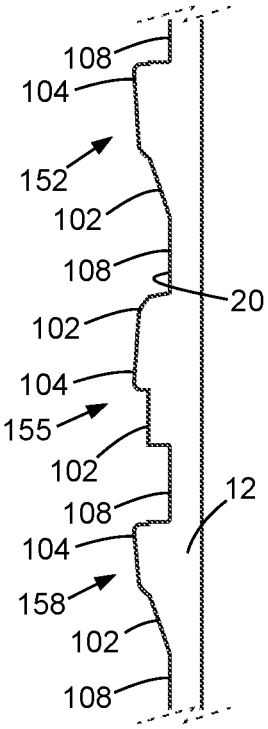
Figure 47:
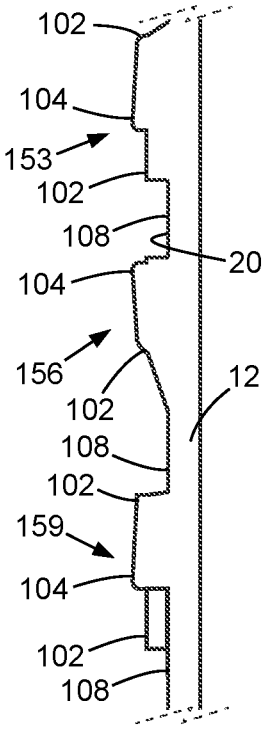

As can be seen in FIGS. 45 to 47, laterally and longitudinally adjacent (i.e., orthogonally adjacent) raised portions alternate between having the respective higher portion 104 located towards a forwards direction (for raised portions 152, 154, 156, 158) or towards a rearwards direction (for raised portions 151, 153, 155, 157, 159. Lower portions 102 are also indicated as is the upper surface 20 from which the raised portions protrude. The upper surface 20 in the deck sheet base thickness regions 108 of the deck sheet 12 follows the contour of the kick and arch so is also a contoured surface from which the raised portions protrude.

Figure 48:
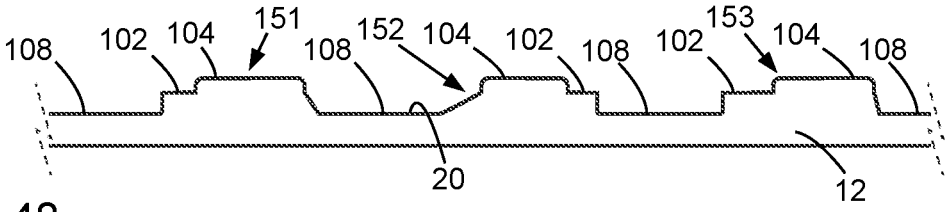
Figure 49:
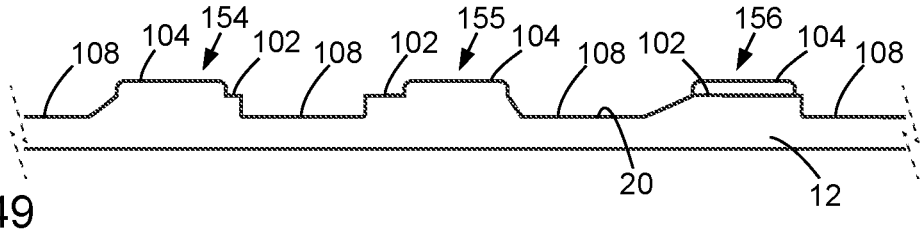
Figure 50:
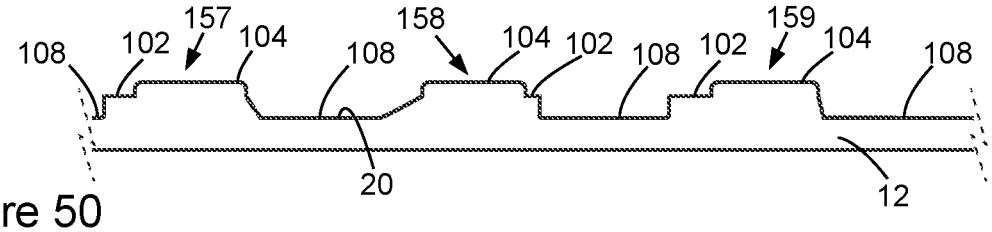

In the lateral section FIGS. 48 to 50 the raised portions are not shown strongly inclined or with the higher portion on alternating sides. However, it can be desirable to incline the raised portions laterally in addition to the longitudinal inclination shown in FIGS. 45 to 47. For example, raised portion 151 can be inclined towards the back left, so the higher portion is located towards both the left and backwards directions and the lower portion is located towards both the right and forwards directions. Raised portions 153, 155, 157 and 159 can be similarly inclined towards the back left. Raised portion 152 can be inclined towards the front right, so the higher portion is located towards both the right and forwards directions and the lower portion is located towards both the left and backwards directions. Raised portions 154, 156 and 158 can be similarly inclined towards the front right. an alternating pattern of diagonally inclined raised portions.

A proportion of the raised portions in a region can be inclined in a particular direction, with other proportions of raised portions in the same region inclined in different directions. For example, as described above, the raised portions 151-159 alternate between being higher towards the forwards direction, or higher towards the backwards direction. However as also described above the raised portions can be diagonally inclined, so can alternate between for example a front right and a back left direction of inclination. Other variations are possible, with alternating between a front left and a front right inclination for example. Also, it is not necessary to alternate the inclination of orthogonally adjacent raised portions, so the mix of inclination directions and the distribution of similarly inclined raised portions can be complex or even random as long as the desired proportions of raised portions in specific inclination directions are met within a region.

Typically, if at least some of the raised portions in a region are inclined in only one or maybe two individual directions, the proportion of raised portions inclined in any one direction can be at least twenty-five percent, but can be thirty-five or even forty or forty-five percent. However if there are proportions of the raised portions that are inclined in three directions, the proportion of raised portions inclined in any one of the three directions is typically around twenty-five percent, but can vary from ten percent, to fifteen, twenty, or for one of the three directions can be higher than twenty-five percent, such as thirty or thirty-five percent.

Figure 51:
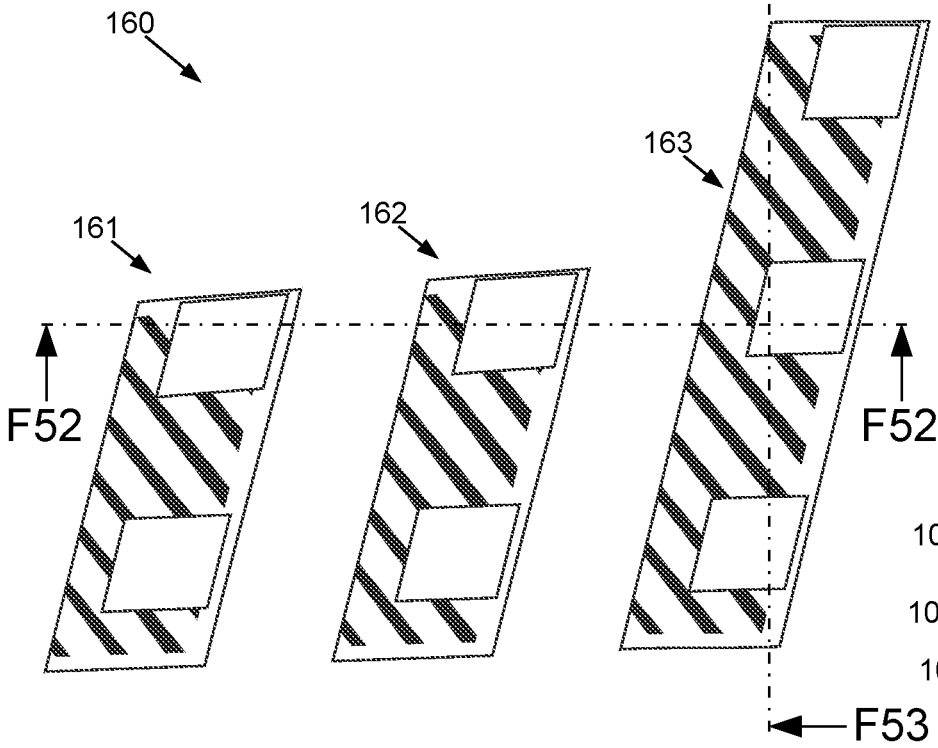
FIG. 51 shows a group of three bars from FIG. 43.
Figure 53:
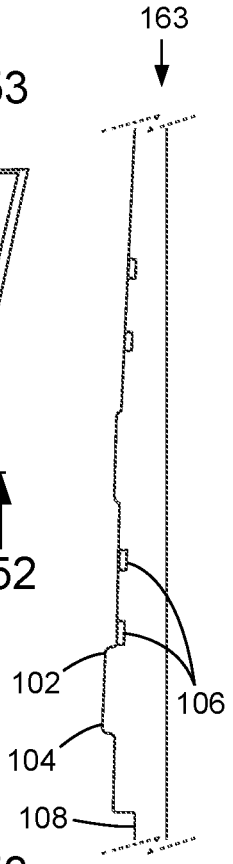
FIG. 53 is a section view through one of the bars of FIG. 51.
Figure 52:
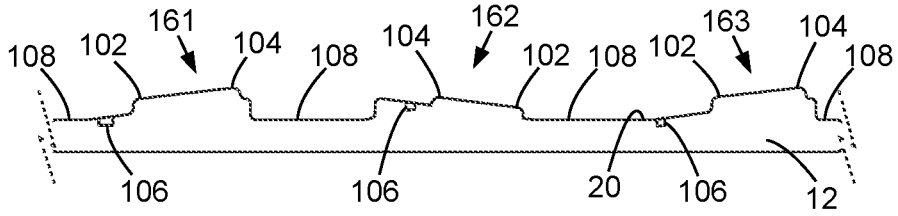
FIG. 52 as a section view through the bars of FIG. 51.

The three bars of substantially longitudinally oriented rectangular raised portions 161, 162, 163 shown in FIG. 51 can vary in lateral and/or longitudinal inclination relative to each other. The section along line F52 is shown in FIG. 52 and the second along line F53 is shown in FIG. 53. In this example, the three bars of substantially longitudinally oriented rectangular raised portions 161, 162, 163 alternate in lateral inclination, as visible in FIG. 52. The first and third bars 161, 163 have the higher portion 104 towards a right direction and the lower portion 102 towards a left direction, i.e., they are inclined or angled upwards towards the right direction. Conversely the second bar 162 has the higher portion 104 towards a left direction and the lower portion 102 towards a right direction, i.e., inclined or angled upwards towards the left direction.

As can be seen in FIG. 53, the bar or substantially longitudinally oriented rectangular raised portion 163 is inclined longitudinally, being higher towards the backwards direction. Grooves 106 formed into the bar and protrusions extending from the bar can have approximately the same angle of inclination as the bar as shown, so the higher portion 104 is towards a backward direction and the lower portion 102 is towards a forward direction, or they can be inclined relative to the bar to reduce or exaggerate their angular profile.

Any or all of the regions R1, R2, R3, R4 and/or R5 shown in FIG. 14 can be mirrored about a centre-line of the deck or traction pad. For example, in FIG. 14, all the labelled regions are on the right-hand side of the pad, but each is mirrored on the left-hand side of the pad. Taking region R3 as an example, it is located to the right of the arch region of the pad and in-front of the kick region of the pad. The edges of R3 may overlap with the edges of the arch and kick, so it is more precise to say that the centre of the region R3 lies, or is located, to the right of the arch and in front or forward of the kick. Similarly, the mirror region of region R3 would have its centre located to the left of the arch and in front or forwards of the kick.

Regions R1 & R2 are located towards the front right corner, so their mirror regions would be located towards the front left corner of the pad. The raised portions in R1 can be raised towards the front only, or include other directions. Similarly, the raised portions in R2 can be raised to the front, or to the right or both. As with the FIGS. 43 to 53 versions of R3 which have at least some of the pattern of raised portions alternating in direction of the higher portion, raised portions in other regions such as in R2 can alternate in the lateral and/or direction of the higher portion. For example, the primarily longitudinally oriented and approximately rectangular raised portions in R2 of FIG. 14, can have their higher 104 portions towards a forward direction on the respective raised portion as shown in FIG. 20, but alternate in lateral inclination. The primarily longitudinally oriented and approximately rectangular raised portion 114 of FIG. 15 can have its higher portion 104 located towards the right of the raised portion as shown in FIG. 21, but the similar adjacent approximately rectangular raised portion to the right can have its highest portion towards a left direction and, and the smaller approximately rectangular raised portion to the right of that can have its highest portion towards the right. Any such alternating or complex pattern of highest portions of raised portions in any region on the right-hand side of the pad can be mirrored on the left-hand side of the pad.

Multiple stiffness kick and/or arch portions can be used with the deck sheet of FIGS. 14 and 15 having directional traction 100, as can the arch base portion 68 integrated with the kick of FIGS. 8 to 13.

Combinations of the above can be used. For example, the deck sheet can be moulded to a preformed arch, the resulting moulded deck-arch being subsequently bonded to the kick. The final shape of the traction pad can be fully defined by the mould which minimises waste. Conversely the contoured deck sheet, kick and arch can be moulded and/or bonded, then the final width and length (or the shape in top view) can be die cut for example. The use of a final die-cutting step can allow for different outer shapes of traction pad and different slits to be provided to allow parts of the traction pad to be splayed out or separated as is known, without needing to change the mould. For example, selective use of die-cutting can allow a moulded traction pad to be separated into a central part and side parts for those users who wish to splay out the traction pad on the water-sports board upon installation.

Modifications and variations as would be apparent to a skilled addressee are deemed to be within the scope of the present invention. For example, the traction pad 10 can include perforations as are well known. The deck sheet 12 can include a logo which can be printed, inlaid or using any other known method.

Alternatively or additionally, slots (not shown) similar to the slot 72 in the top of the kick can be provided in the lower surface 34 of the kick 58 or even in a single-stiffness kick 14 to enable the kick to bend to conform to the curvature of the top surface of the surfboard to which it is then adhered. The slot 72 and the curved lower surface can also be applied to a single-piece kick 14.

The invention claimed is:

1. A traction pad for a water board comprising:

a deck portion;

a kick portion, or the kick portion and an arch portion;

the kick portion having at least a kick upper surface and a kick lower surface, the deck portion substantially covering the kick upper surface;

the traction pad having a pad lower surface, wherein the traction pad or a portion of the traction pad is molded, and wherein the traction pad includes at least one of the following five features a) to e) when the traction pad is in use:

a) the deck portion is molded to substantially conform to a shape to accommodate the kick portion, or to substantially conform to a shape to accommodate the kick portion and the arch portion, before being fixed, molded or bonded to said kick portion or to the kick portion and the arch portion;

b) the traction pad is formed by molding the deck portion and at least the kick portion, or the deck portion and at least the kick portion and the arch portion, together in a mold to control contour of the pad lower surface, the kick portion, or the kick portion and the arch portion, including a respective contoured upper surface, the deck portion including a lower surface, the traction pad being formed by molding the respective contoured upper surface of the kick portion to a respective kick region of the lower surface of the deck portion, or by molding the respective contoured upper surface of the kick portion to the kick region and an upper surface of the arch portion to an arch region, of the lower surface of the deck portion, the kick portion having, in use, an at least backwards facing surface, the kick portion including at least one slot extending substantially longitudinally in use from the at least backwards facing surface through the kick portion contoured upper surface or through the kick lower surface;

c) the kick portion, when formed, has the kick lower surface contoured to at least partially accommodate a contour of the water board, the kick lower surface having a curved and/or concave profile in end view;

d) the deck portion is molded, and has raised portions protruding from a baseline surface of the deck portion by a protrusion height relative to the baseline surface, at least some of the raised portions including a higher portion and a lower portion, the protrusion height of the higher portion being greater than the protrusion height of the lower portion, a proportion of the raised portions in at least a first region of the baseline surface have the respective higher portion located in a left direction in use on the respective raised portion, a proportion of the raised portions in at least a second region of the baseline surface have the respective higher portion located in a forward direction in use on the respective raised portion, a proportion of the raised portions in at least a third region of the baseline surface have the respective higher portion located in a right direction in use on the respective raised portion;

and/or e) the kick portion has, in use, an at least backwards facing surface, wherein the kick portion includes open back holes extending into the kick portion from the at least backwards facing surface without the back holes passing right through the kick portion.

2. The traction pad as claimed in claim 1 wherein at least the kick portion has a different density or a different stiffness or a different durometer, to the deck portion.

3. The traction pad as claimed in claim 1 wherein the kick portion comprises at least a first constituent portion and a second constituent portion, wherein the first constituent portion has a density different to a density of the second constituent portion.

4. The traction pad as claimed in claim 1 wherein the traction pad includes the arch portion formed separate from the kick portion, the arch portion and the kick portion being fixed, molded or bonded to the deck portion.

5. The traction pad as claimed in claim 4 wherein the arch portion separate from the kick portion comprises at least an arch base portion and an arch upper portion.

6. The traction pad as claimed in claim 1 wherein the pad lower surface includes an adhesive coating.

7. The traction pad as claimed in claim 1 wherein at a leading edge of the kick portion, the kick lower surface and the pad lower surface vary in height by less than 1.5 mm over a distance of less than 10 mm along the pad lower surface.

8. The traction pad as claimed in claim 1 wherein when the kick portion has the kick lower surface contoured to at least partially accommodate the contour of the water board, a lateral center of the kick portion or of the traction pad under the kick portion is at least 1.5 mm higher than lateral edges of the kick portion or the traction pad.

9. The traction pad as claimed in claim 1 wherein when the traction pad is formed by molding the deck portion and at least the kick portion together, or by molding the deck portion with at least the kick portion and the arch portion together, a skin is formed around the traction pad by the action of heat.

10. The traction pad as claimed in claim 1 wherein the kick portion is molded.

11. The traction pad as claimed in claim 1, wherein the traction pad includes at least one of the features a) to d) and the kick portion has the at least backwards facing surface, in use, including the open back holes extending into the kick portion from the at least backwards facing surface without the back holes passing right through the kick portion.

12. The traction pad as claimed in claim 11, wherein the kick portion includes open side holes extending into the kick portion from an at least side facing surface of the kick portion without the side holes passing right through the kick portion.

13. The traction pad as claimed in claim 1, wherein the kick portion includes open side holes extending into the kick portion from an at least side facing surface of the kick portion without the side holes passing right through the kick portion.

14. The traction pad as claimed in claim 1, wherein when the traction pad includes at least one of the features a), c), d) or e), the kick portion, in use, the at least backwards facing surface, an upper surface and a lower surface, and wherein the kick portion includes at least one slot extending substantially longitudinally in use from the at least backwards facing surface through the upper surface or through the lower surface, the at least one slot including a base portion forming an internal edge of the respective slot; or, when the traction pad includes at least said feature b), the at least one slot includes a base portion forming an internal edge of the respective slot.

15. The traction pad as claimed in claim 14, including side holes extending into the kick portion from an at least side facing surface of the kick portion, wherein at least a proportion of the side holes extend to the respective slot.

16. The traction pad as claimed in claim 14, wherein the base portion has a base portion width which is greater than a width of the slot adjacent the base portion.

17. A molded deck for a traction pad for a water board, the molded deck having an upper surface including raised portions wherein the raised portions protrude from the upper surface by a protrusion height relative to the upper surface, at least some of the raised portions including a higher portion and a lower portion, the protrusion height of the higher portion being greater than the protrusion height of the lower portion around the respective raised portion and;

wherein a proportion of the raised portions in a first region of the upper surface have the respective higher portion located towards at least a left direction, in use, on the respective raised portion;

a proportion of the raised portions in a second region of the upper surface have the respective higher portion located towards at least a forward direction, in use, on the respective raised portion;

a proportion of the raised portions in a third region of the upper surface have the respective higher portion located towards at least a right direction, in use, on the respective raised portion.

18. A traction pad for a water board, wherein the traction pad or a portion of the traction pad is molded, the traction pad having:

first and second opposing surfaces, the first surface being fixed to the water board in use, the second surface being a baseline surface;

raised portions protruding from the baseline surface by a protrusion height relative to the baseline surface, at least some of the raised portions including a higher portion and a lower portion, the protrusion height of the higher portion being greater than the protrusion height of the lower portion;

a proportion of the raised portions in at least a first region of the baseline surface have the respective higher portion located in a left direction in use on the respective raised portion;

a proportion of the raised portions in at least a second region of the baseline surface have the respective higher portion located in a forward direction in use on the respective raised portion;

a proportion of the raised portions in at least a third region of the baseline surface have the respective higher portion located in a right direction in use on the respective raised portion.

19. The traction pad as claimed in claim 18, wherein the proportion of the raised portions in the first region of the baseline surface having the respective higher portion located towards at least a left direction, in use, on the respective raised portion, is at least twenty-five percent, and at least twenty-five percent of the raised portions in the first region of the baseline surface have the respective higher portion located towards at least a forward direction, in use, on the respective raised portion.

20. The traction pad as claimed in claim 18, wherein the proportion of the raised portions in the first region of the baseline surface having the respective higher portion located towards at least a left direction, in use, on the respective raised portion, have the respective higher portion located towards a forwards-left direction, said proportion being at least twenty-five percent.

21. The traction pad as claimed in claim 20, wherein at least twenty-five percent of the raised portions in the first region of the baseline surface have the respective higher portion located towards a backwards-right direction, in use, on the respective raised portion.

22. The traction pad as claimed in claim 20, wherein the proportion of the raised portions in the third region of the baseline surface having the respective higher portion located towards at least a right direction, in use, on the respective raised portion, have the respective higher portion located towards a forwards-right direction, said proportion being at least twenty-five percent.

23. The traction pad as claimed in claim 22, wherein at least twenty-five percent of the raised portions in the third region of the baseline surface have the respective higher portion located towards a backwards-left direction, in use, on the respective raised portion.

24. The traction pad as claimed in claim 18, wherein the proportion of the raised portions in the second region of the baseline surface having the respective higher portion located towards at least a forward direction, in use, on the respective raised portion, is at least twenty-five percent.

25. The traction pad as claimed in claim 24, wherein at least twenty-five percent of the raised portions in the second region of the baseline surface have the respective higher portion located towards at least a forwards-left direction, in use, on the respective raised portion.

26. The traction pad as claimed in claim 18, wherein a proportion of the raised portions in a fourth region of the baseline surface have the respective higher portion located towards at least a forward direction, in use on the respective raised portion;

the first region being located towards a left side of the traction pad and forward of a kick region;

the second region being located towards a front side and the left side of the traction pad;

the third region being located towards a right side of the pad and forward of a kick region;

the fourth region being located towards the front side and the right side of the traction pad.

* * * * *